US005325917A

United States Patent [19]

Szarka

[11] Patent Number: 5,325,917

[45] Date of Patent: Jul. 5, 1994

[54] SHORT STROKE CASING VALVE WITH POSITIONING AND JETTING TOOLS THEREFOR

[75] Inventor: David D. Szarka, Duncan, Okla.

[73] Assignee: Halliburton Company, Duncan, Okla.

[21] Appl. No.: 69,576

[22] Filed: Jun. 1, 1993

Related U.S. Application Data

[62] Division of Ser. No. 781,701, Oct. 21, 1991, abandoned.

[51] Int. Cl.[5] ..... E21B 23/00; E21B 34/14

[52] U.S. Cl. ..... 166/240; 166/318; 166/332

[58] Field of Search ..... 166/240, 332, 318

[56] References Cited

U.S. PATENT DOCUMENTS

| | | | |
|---|---|---|---|
| 2,380,022 | 7/1945 | Burt | 166/332 X |
| 2,435,016 | 1/1948 | Pitts | 166/154 |
| 2,471,382 | 5/1949 | Althouse, Jr. et al. | 166/194 |
| 2,667,926 | 2/1954 | Alexander | 166/332 X |
| 2,672,199 | 3/1954 | McKenna | 166/191 |
| 2,723,677 | 11/1955 | Middleton et al. | 137/370 |
| 2,804,830 | 9/1957 | Garrett et al. | 103/233 |
| 2,832,422 | 4/1958 | Cross, Jr. et al. | 166/216 |
| 2,924,278 | 2/1960 | Garrett et al. | 166/214 |
| 2,965,177 | 12/1960 | Le Bus, Sr. et al. | 166/240 |
| 3,006,374 | 10/1961 | Prachner | 166/332 X |
| 3,051,243 | 8/1962 | Grimmer et al. | 166/224 |
| 3,051,244 | 8/1962 | Litchfield | 166/225 |
| 3,071,193 | 1/1963 | Raulins | 166/226 |
| 3,073,392 | 1/1963 | Dinning et al. | 166/224 |
| 3,115,188 | 12/1963 | Cochran et al. | 166/332 |
| 3,120,267 | 2/1964 | Bayless | 166/332 X |
| 3,151,681 | 10/1964 | Cochran | 166/224 |
| 3,223,160 | 12/1965 | Baker | 166/27 |
| 3,228,473 | 1/1966 | Baker | 166/154 |
| 3,247,905 | 4/1966 | Baker | 166/194 |
| 3,251,416 | 5/1966 | Kiel | 166/44 |
| 3,335,802 | 8/1967 | Seyffert, III | 166/226 |
| 3,355,142 | 11/1967 | Kammerer, Jr. et al. | 251/175 |
| 3,414,060 | 12/1968 | Zak | 166/332 X |
| 3,524,503 | 8/1970 | Baker | 166/289 |
| 3,705,624 | 12/1972 | Pitts | 166/216 |
| 3,760,878 | 9/1973 | Peevey | 166/185 |
| 3,768,556 | 10/1973 | Baker | 166/154 |
| 3,768,562 | 10/1973 | Baker | 166/289 |
| 3,789,926 | 2/1974 | Henley et al. | 166/224 R |
| 3,811,500 | 5/1974 | Morrisett et al. | 166/154 |
| 3,948,322 | 4/1976 | Baker | 166/289 |
| 4,083,401 | 4/1978 | Rankin | 166/332 X |
| 4,105,069 | 8/1978 | Baker | 166/332 X |
| 4,108,257 | 8/1978 | Sizer | 166/154 X |
| 4,278,131 | 7/1981 | Jani | 166/332 |
| 4,364,430 | 12/1982 | Szarka | 166/214 |
| 4,421,165 | 12/1983 | Szarka | 166/151 |
| 4,421,182 | 12/1983 | Moody et al. | 175/65 |

(List continued on next page.)

*Primary Examiner*—Hoang C. Dang

*Attorney, Agent, or Firm*—James R. Duzan; Neal R. Kennedy

[57] ABSTRACT

A short stroke casing valve with positioning and jetting tools therefor. The casing valve has a sliding sleeve within a housing. The housing defines a housing communication port therethrough, and a seal is disposed on longitudinally opposite sides of the housing communication port. The sleeve has a selective latch profile therein adapted for engagement by the positioning tool. The positioning tool has outwardly biased positioner blocks which automatically engage the sliding sleeve. The positioner blocks have a selective latch profile thereon which is adapted for engagement with the latch profile in the sliding sleeve. This latch profile in the positioner tool prevents undesirable engagement of the positioner blocks with any other portion of the casing string except the latch profile in the casing valve. In one embodiment, a non-rotational jetting tool includes a plurality of circumferentially spaced jetting orifices therein. There is a sufficient number of orifices so that at least one of the orifices is substantially radially aligned with the housing communication port when longitudinally aligned therewith, so that jetting through the housing communication port may be accomplished without rotation of the tool string. A jetting tool having rotational jetting is also disclosed.

20 Claims, 19 Drawing Sheets

U.S. PATENT DOCUMENTS

| | | | |
|---|---|---|---|
| 4,457,368 | 7/1984 | Knierimen et al. | 166/217 |
| 4,505,341 | 3/1985 | Moody et al. | 175/65 |
| 4,512,406 | 4/1985 | Vann et al. | 166/297 |
| 4,520,870 | 6/1985 | Pringle | 166/317 |
| 4,625,799 | 12/1986 | McCormick et al. | 166/223 |
| 4,678,035 | 7/1987 | Goldschild | 166/240 X |
| 4,705,107 | 11/1987 | Council et al. | 166/170 |
| 4,781,250 | 11/1988 | McCormick et al. | 166/240 |
| 4,880,059 | 11/1989 | Brandell et al. | 166/332 |
| 4,928,772 | 5/1990 | Hopmann | 166/386 |
| 4,949,788 | 8/1990 | Szarka et al. | 166/285 |
| 4,979,561 | 12/1990 | Szarka | 166/240 |
| 4,991,653 | 2/1991 | Schwegman | 166/312 |
| 4,991,654 | 2/1991 | Brandell et al. | 166/332 |
| 5,029,644 | 7/1991 | Szarka et al. | 166/223 |
| 5,090,481 | 2/1992 | Pleasants et al. | 166/332 X |

SHORT STROKE CASING VALVE WITH POSITIONING AND JETTING TOOLS THEREFOR

This is a divisional of co-pending application Ser. No. 07/781,701, filed on Oct. 21, 1991, now abandoned.

BACKGROUND OF THE INVENTION

1. Field of the Invention

The present invention relates generally to casing valves for use in well bores, to positioning tools for positioning a sliding member in a casing valve and jetting tools for washing a casing bore by spraying fluid through a port in the casing valve. More particularly, the invention relates to a casing valve with a relatively short stroke incorporating a selective latch profile engageable by a positioning tool which is adapted to prevent hangup of the positioning tool in other locations in the casing string. In one embodiment, a non-rotating jetting tool is used.

2. Brief Description of the Prior Art

It is known that sliding sleeve type casing valves can be placed in the casing of a well to provide selective communication between the casing bore and subsurface formation adjacent to the casing valve. One such casing valve is shown in U.S. Pat. No. 4,991,654 to Brandell et al., assigned to the assignee of the present invention. The casing valve includes an outer housing with a sliding sleeve. First and second seals define a sealed annulus within the housing. A latch is disposed in the sealed annulus for latching the sliding valve in its first and second positions. The housing has a plurality of housing ports defined therein, and the sliding sleeve has a plurality of sleeve ports defined therein. A third seal disposed between the sleeve and housing isolates all of the housing ports from all of the sleeve ports when the sleeve is in its first position relative to the housing. When the sleeve is moved to its second position relative to the housing it is aligned so that the sleeve ports are in registry with the housing ports. This alignment is achieved by a lug and groove which are also disposed in the sealed annulus of the casing valve.

The sleeve in the casing valve of Brandell et al. is positioned by the positioning tool disclosed in U.S. Pat. No. 4,979,561 to Szarka, assigned to the assignee of the present invention. The positioning tool includes a drag assembly having a longitudinal passageway defined therethrough. An inner mandrel is disposed through the longitudinal passageway of the drag assembly and is longitudinally movable relative to the drag assembly. An operating assembly is provided for selectively operatingly engaging the sliding member in the casing valve in response to longitudinal reciprocating motion of the inner mandrel relative to the drag assembly.

Once the sliding sleeve in the casing valve is moved to its second position, fluid may be jetted through the jetting tool of Szarka et al. disclosed in U.S. Pat. No. 5,029,644, also assigned to the assignee of the present invention. The jetting tool is connected at a rotatable connection to the positioning tool. The jetting tool is thus rotatable relative to the positioning tool and the casing valve. The jetting tool hydraulically jets the casing valve as the jetting tool is rotated relative thereto.

The casing valve of Brandell et al. was designed to have a relatively short stroke compared to some prior art valves at that time. However, it is desirable to even further shorten the stroke of such valves. The present invention provides a casing valve with an even shorter stroke.

In some instances, it is possible that the prior art positioning tool can hang up in the casing string by inadvertently engaging recesses which exist in the casing string. Also, some auxiliary tools, such as retrievable bridge plugs have portions thereof, such as drag blocks, which may fall into the long gap of the sliding sleeve in prior casing valves and hang up therein. Any of these hangups can cause damage to the positioning tool, casing valve and/or auxiliary tools.

Accordingly, there is a need to prevent such hangups, and the present invention solves this problem by providing a sliding sleeve in the casing valve with a selective latch profile, and the positioning tool has a positioner block with a corresponding selective latch profile so that the positioner block will latch only in the profile in the casing valve and not engage anything else in the casing string.

A further possible problem with prior art tools of this type is that in small bores, it may be difficult to provide jetting tools which are rotatable. The present invention solves this problem by providing one embodiment with a jetting tool utilizing a plurality of jets such that at least one of the jets is substantially aligned with the ports in the casing valve regardless of the angular relationship between the jetting to and casing valve.

SUMMARY OF THE INVENTION

The present invention is a downhole tool comprising a sliding sleeve casing tool apparatus for use in a casing string of a well, a positioning tool apparatus for positioning a sliding member of a well tool, and an apparatus for hydraulically jetting a well tool disposed in a well.

The sliding sleeve casing tool apparatus comprises an outer housing having a longitudinal passageway defined therethrough and having a side wall with a housing communication port defined through the side wall, a sliding sleeve slidably disposed in the longitudinal passageway and being selectively movable relative to the housing between a first position blocking the communication port and a second position wherein the communication port is communicated with the longitudinal passageway, and sealing means disposed on longitudinally opposite sides of said port for sealing between said sleeve and said housing when said sleeve is in said first position. The sliding sleeve casing tool apparatus further comprises position latching means for releasably latching the sleeve in its first and second positions.

In one embodiment, an end of the sleeve is on one longitudinal side of the port when the sleeve is in the first position, and that end of the sleeve is on the opposite longitudinal side of the port when the sleeve is in the second position.

In another embodiment, the housing communication port is one of a plurality of longitudinally spaced housing communication ports defined through the side wall. The sleeve defines a plurality of sleeve communication ports therethrough, each sleeve communication port being adapted for substantial alignment with a corresponding housing communication port when the sleeve is in the second position, and the sealing means comprises a seal disposed on longitudinally opposite sides of each of the housing communication ports and each of the sleeve communication ports. In this embodiment, an alignment means is provided for preventing relative rotation between the sleeve and the housing.

In the preferred embodiment, the sliding sleeve defines a latch profile thereon adapted for engagement by a corresponding latch profile on the positioning tool. The latch profile is preferably characterized by first and second spaced grooves defined in the sleeve.

The positioning tool apparatus comprises an inner mandrel, and operating means for selectively operably engaging the sliding member of the well tool in response to the longitudinally reciprocating motion of the inner mandrel. The operating means comprises radial outwardly biased engagement means for automatically engaging the sliding member of the well tool when aligned therewith.

The engagement means comprises a plurality of positioner blocks circumferentially spaced about a longitudinal axis of the inner mandrel and having a radially outwardly facing engagement surface thereon, and biasing means for biasing the positioner blocks radially outwardly from the longitudinal axis. Each of the positioner blocks has a tapered locking surface defined on an end thereof. A locking means is provided for lockingly engaging the tapered locking surfaces and thereby locking the positioner blocks radially outwardly.

In the preferred embodiment, the plurality of positioner blocks is a first plurality of positioner blocks, and the positioning tool apparatus further comprises a second plurality of positioner blocks circumferentially spaced around the longitudinal axis and a second biasing means for resiliently biasing the second positioner blocks radially outwardly from the longitudinal axis. Each of the second positioner blocks has a radially outwardly facing engagement surface thereon.

In this embodiment, the locking means is connected to the inner mandrel and is adapted for locking the engagement means in operable engagement with the sliding member. The apparatus further comprises position control means, operably associated with the inner mandrel, for permitting the inner mandrel to reciprocate longitudinally and selectively lock and unlock the engagement means with the locking means. The locking means includes upper and lower annular wedges having tapered annular locking surfaces thereon complementary to the locking surfaces of the first and second plurality of positioner blocks, respectively.

In the positioning tool apparatus, the engagement surfaces on the positioner blocks define at least in part a selective latch profile adapted for matching engagement with the corresponding latching profile in the sliding member of the well tool. In the preferred embodiment, the engagement surface is one of a pair of spaced engagement surfaces defining a groove therebetween. This unique selective latch profile prevents the positioner blocks from undesirably engaging any other portion of the casing string as the positioning tool is run into the well.

That is, the latching profile on the positioning tool is adapted for preventing engagement with any other portion of the casing string except the latching profile and the sliding sleeve in the sliding sleeve casing tool apparatus.

The position control means comprises a J-slot defined in one of the inner mandrel and the operating means of the positioning tool, and a lug connected to the other of the inner mandrel and operating means. The lug is received in the J-slot.

In one embodiment of the apparatus for hydraulically jetting a well tool is adapted for use with a well tool having a sliding member and defining a communication port through a side wall thereof. The apparatus for hydraulically jetting comprises operating means for operably engaging the sliding member of the well tool and moving the sliding member between a closed position thereof and an open position wherein the communication port is in communication with a longitudinal passageway through the well tool, and a jetting means attached to the positioner means for providing non-rotational hydraulic jetting of fluid through the communication port.

The jetting means preferably provides a wide pattern of jetting of fluid therefrom so that at least a portion of the fluid is jetted through the communication port. The jetting means comprises a jetting sub defining a plurality of radially oriented and angularly spaced jetting ports therethrough so that at least one of the jetting ports is substantially alignable with the communication port by longitudinal movement only of the jetting sub. The apparatus further comprises a jetting nozzle in each jetting port, each jetting nozzle being aligned with one of the jetting ports and in communication therewith.

Another embodiment of the jetting apparatus provides conventional rotational jetting.

In either embodiment of the jetting apparatus, a back check valve means may be provided for permitting a tubing string with the positioning means and jetting means therein to fill while the apparatus is run into the well.

Numerous objects, features and advantages of the present invention will be readily apparent to those skilled in the art upon a reading of the following disclosure when taken in conjunction with the accompanying drawings.

DESCRIPTION OF THE PREFERRED EMBODIMENT

Figure 1:
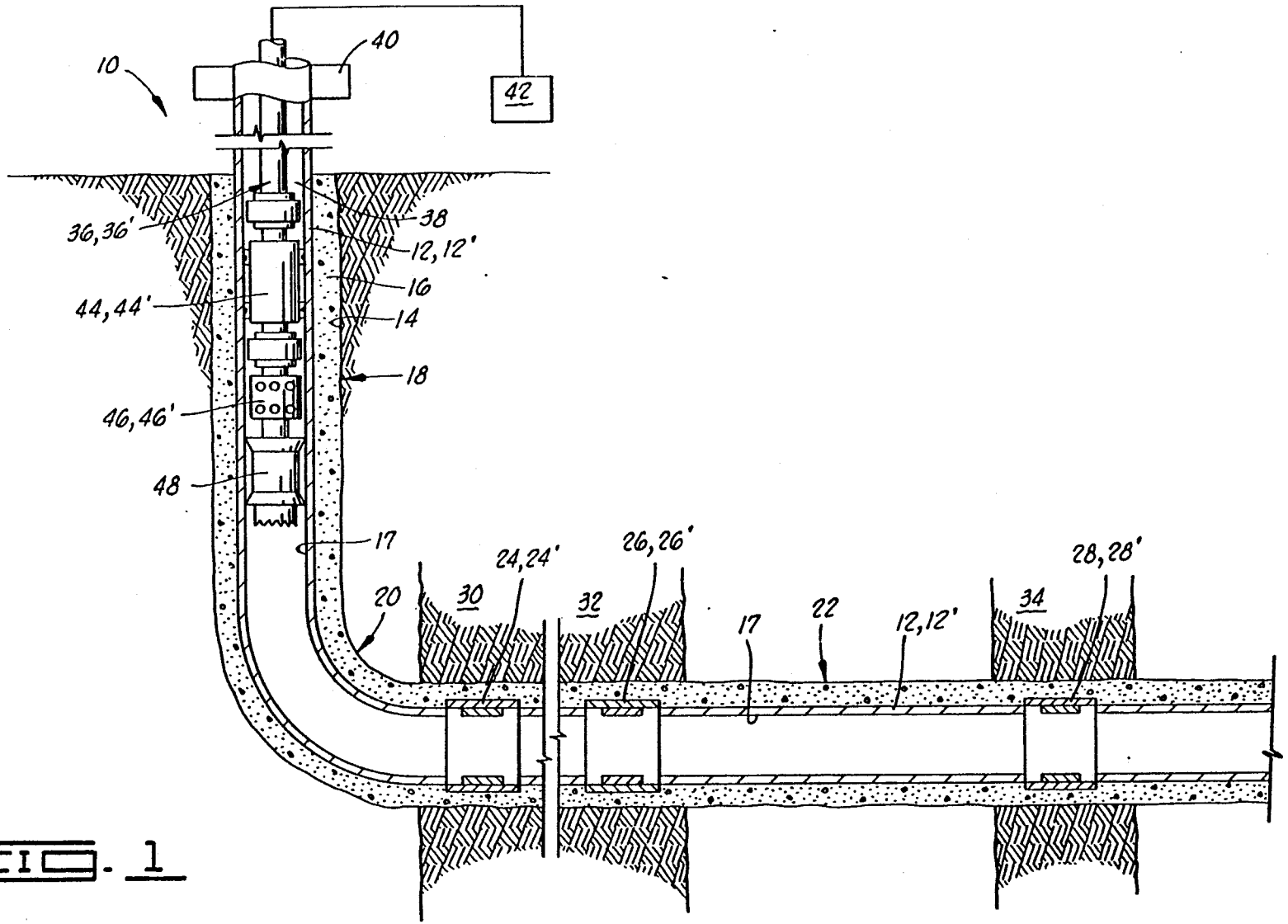
FIG. 1 is a schematic elevation sectioned view of a well having a substantially deviated well portion. A work string is shown being run into the well including a positioner means, a jetting tool assembly, and a wash tool. The deviated portion of the well is illustrated with multiple casing valves placed in the casing string.

Referring now to the drawings, and more particularly to FIG. 1, a well is shown and generally designated by the numeral 10. Well 10 is constructed by placing a casing string or 12' in a bore hole 14 and cementing the same in place with cement as indicated by numeral 16. The numeral 12 indicates a first embodiment casing string, and the numeral 12' indicates the second embodiment casing string. The casing string may be in the form of a liner instead of the full casing string 12, 12' illustrated. Casing string 12, 12' has a casing bore 17 therein.

Well 10 has a substantially vertical portion 18, a radiused portion 20, and a substantially non-vertical deviated portion 22 which is illustrated as being a substantially horizontal well portion 22. Although the tools described herein are designed to be especially useful in the deviated portion of the well, they can, of course, also be used in the vertical portion of the well.

Spaced along the deviated well portion 22 of casing 12, 12' are a plurality of casing valves which are indicated by the numerals 24, 26 and 28 for the first embodiment and 24', 26' and 28' for the second embodiment. First embodiment casing valve 24, which is identical to casing valves 26 and 28, is shown in detail in FIGS. 2A-2C. Second embodiment casing valve 24', which is identical to casing valves 26' and 28', is shown in detail in FIGS. 5A-5D. Each of first embodiment casing valves 24, 26 and 28 and second embodiment casing valves 24' 26' and 28' is located adjacent to a subsurface zone or formation of interest such as zones 30, 32 and 34, respectively.

In FIG. 1, a tubing string 36 or 36' having a plurality of tools connected to the lower end thereof is shown as being lowered into well casing 12, 12'. A well annulus 38 is defined between tubing string 36, 36' and casing string 12, 12'. A blowout preventer 40 located at the surface is provided to close well annulus 38. A pump 42 is connected to tubing string 36, 36' for pumping fluid down tubing string 36, 36'.

Tubing string 36, 36' shown in FIG. 1 has a first embodiment positioner tool apparatus 44 or second embodiment positioner tool apparatus 44', a first embodiment jetting tool apparatus 46 or a second embodiment jetting tool apparatus 46', and may also have a wash tool apparatus 48 connected thereto. Tubing string 36 for the first embodiment is shown in detail in FIGS. 3A-3F, and the second embodiment tubing string 36' is shown in detail in FIGS. 6A-6G.

FIRST EMBODIMENT CASING VALVE

Figure 2A:
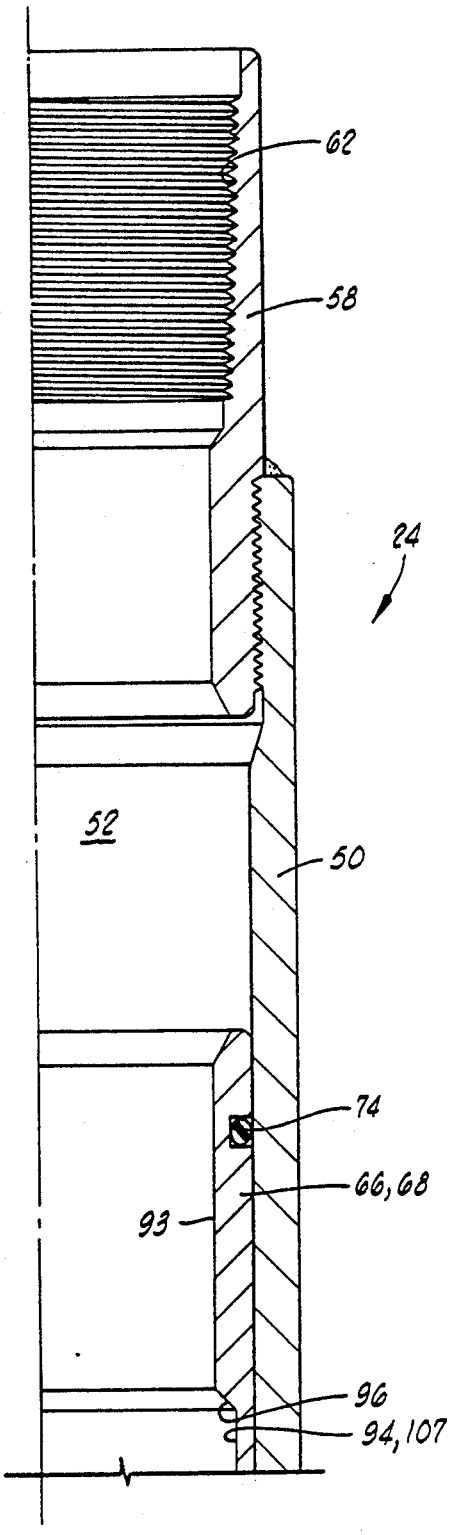
FIGS. 2A–2C comprise a cross-sectional view of a first embodiment of the casing valve of the present invention. The sleeve is shown in a closed position.
Figure 2B:
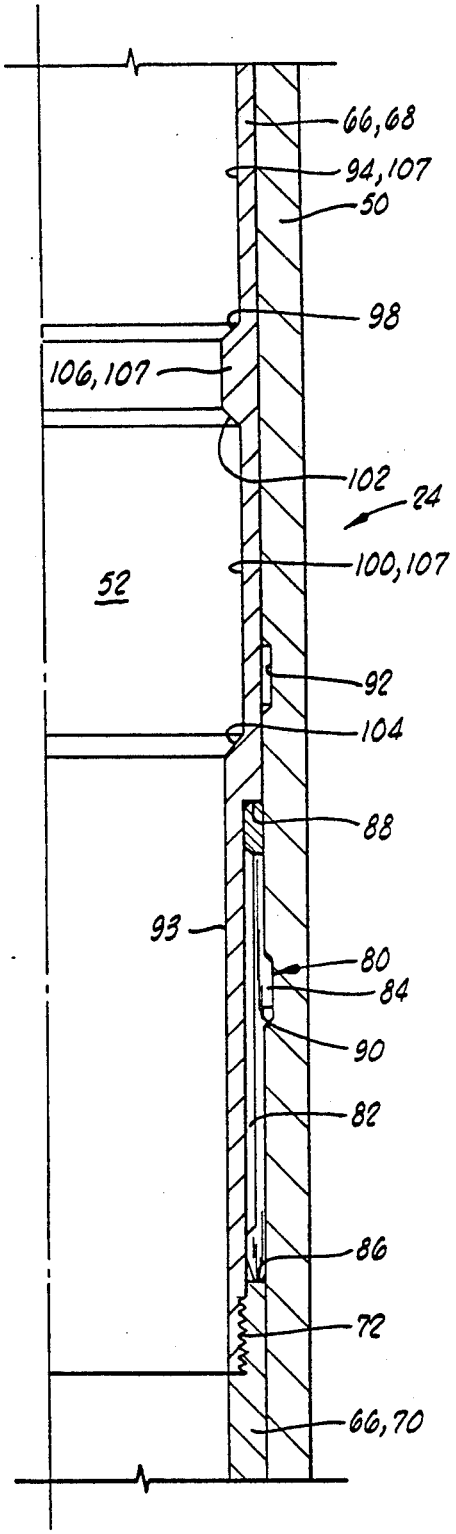
Figure 2C:
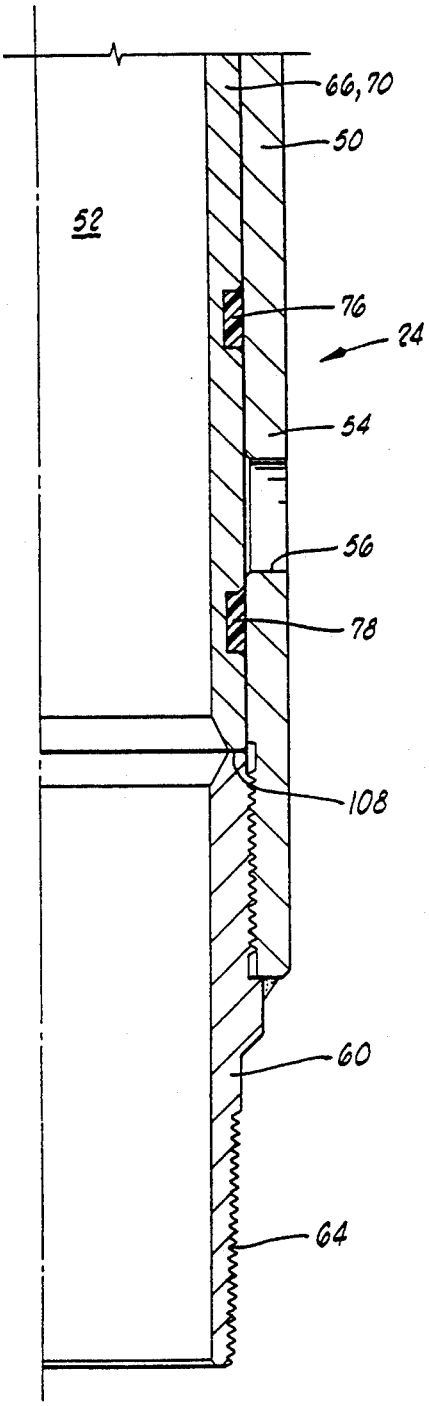

Casing valve 24, which may also generally be referred to as a sliding sleeve casing tool apparatus 24, is shown in detail in FIGS. 2A-2C. Casing valve 24 includes an outer housing 50 having a longitudinal passageway 52 defined therethrough and having a side wall 54 with a plurality of housing communication ports 56 defined through the side wall.

Upper and lower bodies 58 and 60 are attached to the upper and lower ends of housing or case 50, respectively, to facilitate handling and makeup of sliding sleeve casing tool 24 into casing string 12. Upper body 58 has an internal thread 62 for connection to an upper portion of casing string 12, and lower body 60 has an external thread 64 for connection to a lower portion of casing string 12.

Casing valve 24 also includes a sliding sleeve 66 which comprises a collet sleeve 68 attached to a seal sleeve 70 at threaded connection 72. Sleeve 66 is disposed in longitudinal passageway 52 of housing 50 and is selectively movable relative to housing 50 between a first position shown in FIGS. 2A-2C blocking or covering housing communication ports 56 and a second position illustrated in FIGS. 4A-4F wherein housing communication ports 56 are uncovered and are communicated with longitudinal passageway 52, as will be further described herein.

Casing valve 24 also includes an upper wiper 74 which provides wiping engagement between collet sleeve 66 and housing 50. Casing valve 24 further includes spaced lower seals 76 and 78 which provide sealing engagement between seal sleeve 70 and housing 50. In the first position of sleeve 66, it will be seen that seals 76 and 78 are on longitudinally opposite sides of housing communication ports 56, thus sealingly separating ports 56 from longitudinal passageway 52.

A position latching means 80 is provided for releasably latching sliding sleeve 66 in its first and second positions. Position latching means 80 is disposed in an annulus 82 defined between sliding sleeve 66 and housing 50. It will be seen that annulus 82 is protected between upper wiper 74 and lower seal 76.

Position latching means 80 includes a spring collet 84, which may also be referred to as a spring biased latch means 84. Spring collet 84 is longitudinally positioned between upper end 86 of seal sleeve 70 of sliding sleeve 66 and downwardly facing shoulder 88 on collet sleeve 68 of sliding sleeve 66. Thus, collet 84 moves longitudinally with sliding sleeve 66 and may be considered to be attached thereto.

Position latching means 80 also includes first and second radially inwardly facing longitudinally spaced grooves 90 and 92 defined in housing 50 and corresponding to first and second positions, relatively, of sliding sleeve 66.

By placing spring collet 84 in annulus 82, the collet is protected in that cement, sand and the like are prevented from packing around the collet and impeding its successful operation.

It is noted that position latching means 80 could also be constructed by providing a spring latch attached to housing 50 and providing first and second grooves in sliding sleeve 66 rather than vice versa as they have been illustrated.

Sliding sleeve 66 has a longitudinal sleeve bore 93 defined therethrough. Collet sleeve 68 of sliding sleeve 66 defines a first radially inwardly facing groove 94 in sleeve bore 93 with upper and lower chamfers 96 and 98 at the upper and lower ends of groove 94, respectively. See FIGS. 2A and 2B.

Spaced below first groove 94, collet sleeve 68 defines a second radially inwardly facing groove 100 therein having upper and lower chamfers 102 and 104 at the upper and lower ends thereof, respectively, as seen in FIG. 2B.

It may be said that first groove 94 and second groove 100 are separated by a ring or shoulder portion 106 in collet sleeve 68 of sliding sleeve 66.

First and second grooves 94 and 100 and ring 106 therebetween may be said to form a latch profile 107 adapted for engagement by positioning tool 44, as will be further described herein.

Sliding sleeve 66 has a lower end 108 which is the lower end of seal sleeve 70. End 108 is positioned adjacent to lower body 60 and below housing communication ports 56 when sliding sleeve 66 is in the first position shown.

As previously indicated, sliding sleeve 66 is selectively movable relative to housing 50 between the first position of FIGS. 2A-2C and the second position shown in FIGS. 4A-4F wherein lower end 108 of sliding sleeve 66 is positioned above housing communication ports 56 so that the ports are uncovered and in communication with longitudinal passageway 52.

It will be seen that sliding sleeve 66 of casing valve 24 has a relatively short sleeve travel as compared to the casing valve of Brandell disclosed in U.S. Pat. No. 4,991,654.

FIRST EMBODIMENT POSITIONING TOOL

Referring now to FIGS. 3A-3F, a portion of tubing string 36 is shown made up of positioning tool 44 and jetting tool 46. These same components are shown in place within casing valve 24 in FIGS. 4A-4F.

Positioning tool 44 may be generally described as a positioning tool apparatus for positioning a sliding member of a well tool, such as sliding sleeve 66 of casing valve 24.

The primary components of positioning tool apparatus 44 are a guide means 110, an inner positioning mandrel 112 and an operating means 114.

Figure 3A:
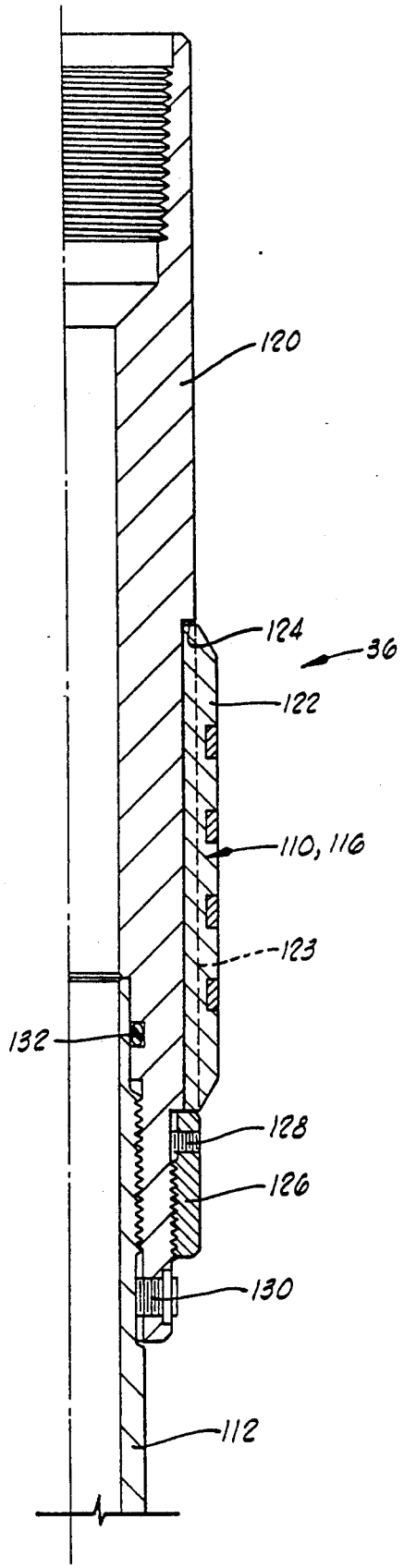
FIGS. 3A–3F show a section of the tool string of the present invention including the positioning tool and the jetting tool.
Figure 3B:
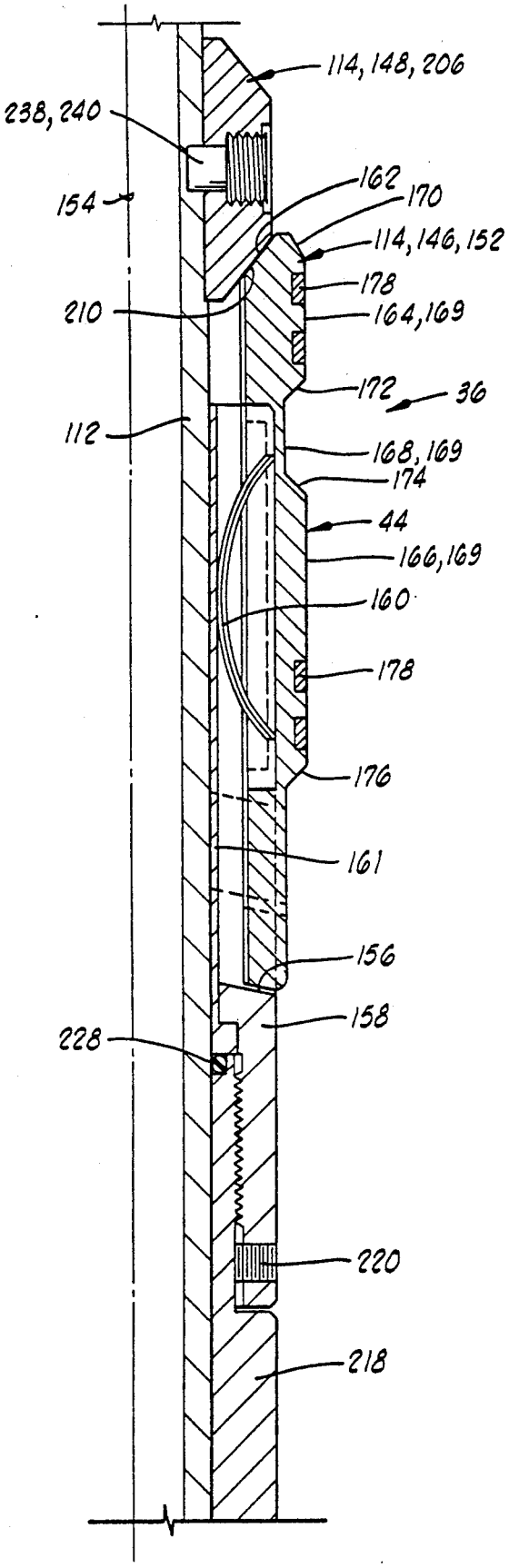
Figure 3C:
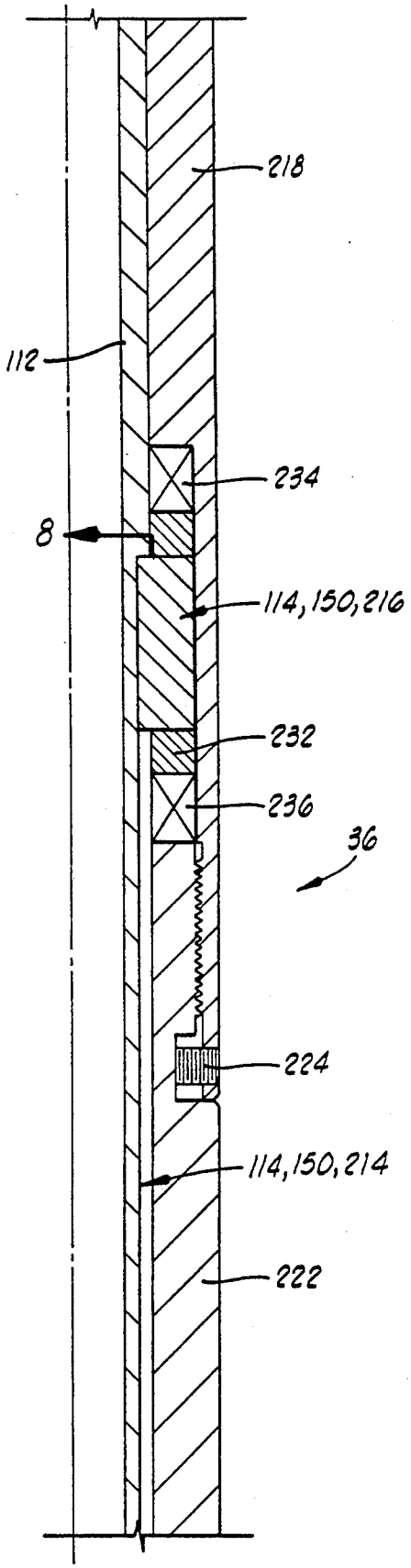
Figure 3D:
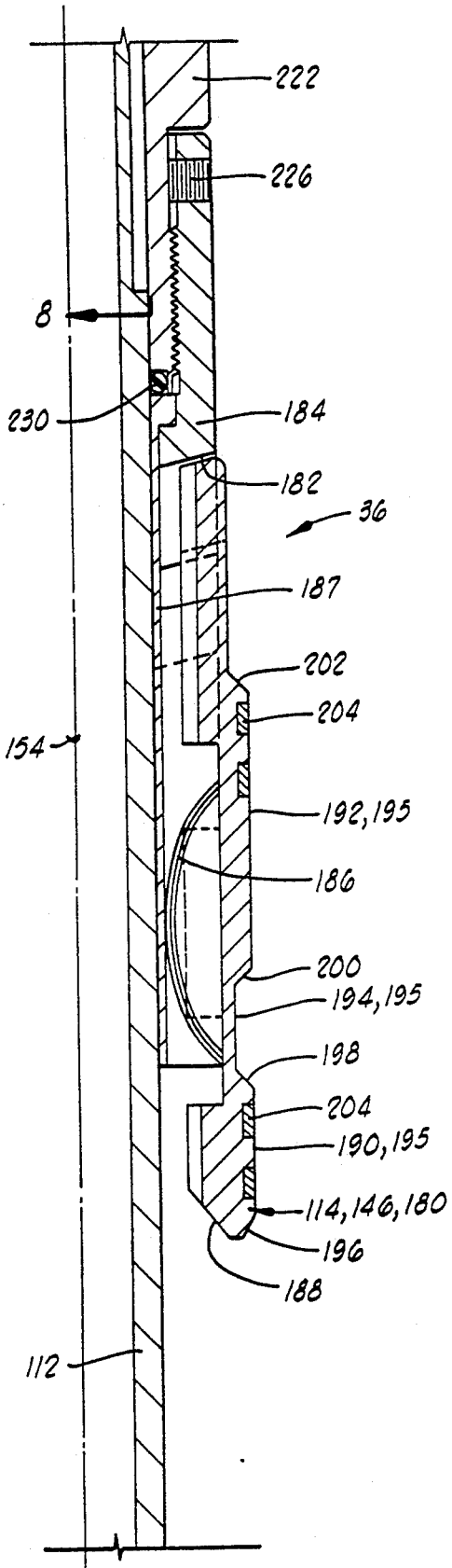
Figure 3E:
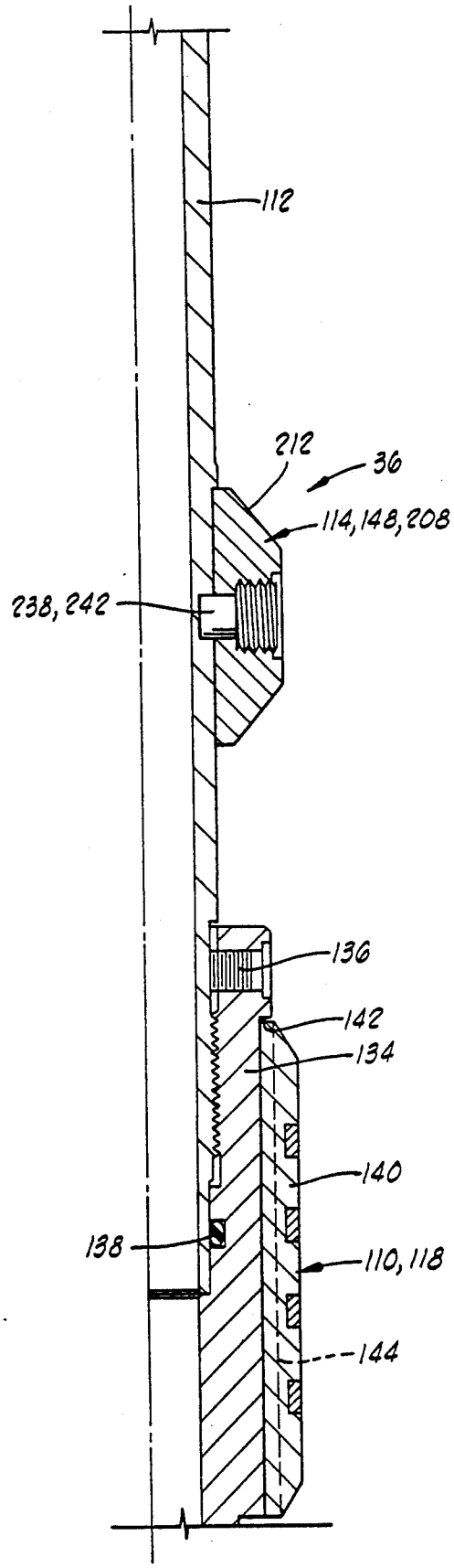

Guide means 110 includes an upper guide assembly 116 shown in FIG. 3A and a lower guide assembly 118 shown in FIG. 3E.

Upper guide assembly 116 includes an upper adapter 120 with a star guide assembly 122, which has a plurality of flats 123, disposed thereon adjacent to a shoulder 124 on the upper adapter. Star guide assembly 122 is held in position by a star guide retainer 126 which is threaded to upper adapter 120. A set screw 128 may be used to lock retainer 126 in place.

The upper end of inner positioning mandrel 112 is threadingly engaged with upper adapter 120 and locked in place by a set screw 130. An O-ring seal 132 provides sealing engagement between upper adapter 120 and inner positioning mandrel 112.

Lower guide assembly 118 of guide means 110 includes a lower adapter 134 which is threadingly engaged by the lower end of inner positioning mandrel 112. A set screw 136 locks mandrel 112 and lower adapter 134 together. An O-ring seal 138 provides sealing engagement therebetween.

A star guide assembly 140 is disposed on lower adapter 134 adjacent to shoulder 142 on the lower adapter. Star guide assembly 140 is preferably substantially the same as star guide assembly 122 and has a plurality of flats 144 thereon.

Operating means 114 provides a means for selectively operably engaging sliding sleeve 66 of casing valve 24 in response to longitudinally reciprocating motion of inner positioning mandrel 112. More particularly, operating means 114 includes an engagement means 146 slidably disposed on inner positioning mandrel 112 for operably engaging sliding sleeve 66 of casing valve 24. Operating means 114 also includes a locking means 148 connected to inner positioning mandrel 112 for locking engagement means 146 so that the engagement means in operable engagement with sliding sleeve 66 of casing valve 24. Operating means 114 further includes a position control means 150 operably associated with engagement means 146 and inner positioning mandrel 112 for permitting the mandrel to reciprocate longitudinally relative to engagement means 146 and selectively lock and unlock engagement means 146 with locking means 148.

Engagement means 146 includes a first plurality of positioner blocks 152 circumferentially spaced about a longitudinal axis 154 of positioner tool 44 and inner positioning mandrel 112. Each positioner block 152 is disposed in a window 156 of a positioner body 158. A biasing means, such as a plurality of springs 160 engaging inner positioning mandrel 112, biases each positioner block 152 radially outwardly. A spring sleeve 161 is disposed between inner mandrel 112 and springs 160 so the springs do not drag on the inner mandrel.

At the upper end of each positioner block 152 is a tapered locking surface 162. Each positioner block 152 also has a first engagement surface 164 and a second engagement surface 166, spaced from first engagement surface 164, facing radially outward thereon. First and second engagement surfaces 164 and 166 are separated by a recess 168.

First and second engagement surfaces 164 and 166 and recess 168 may be said to form a selective latch profile 169 which is adapted for engagement with latch profile 107 in sliding sleeve 66 of casing valve 24, as will be further described herein.

A pair of chamfers 170 and 172 are located at opposite ends of first engagement surface 164, and similarly, chamfers 174 and 176 are located on opposite ends of second engagement surface 166.

Either or both of first and second engagement surfaces 164 and 166 may have hardened inserts 178 disposed therein.

Engagement means 146 further includes a second plurality of positioner blocks 180 similarly located around axis 154. Each positioner block 180 is disposed in a window 182 of a positioner body 184. In the preferred embodiment, positioner blocks 180 are identical to positioner blocks 152, and positioner body 184 is identical to positioner body 158. A biasing means, such as spring 186 engaging inner positioning mandrel 112, biases each positioner block 180 radially outwardly. A spring sleeve 187 is disposed between inner mandrel 112 and springs 186 so that the springs do not drag on the inner mandrel.

Each positioner block 180 has a locking surface 188 at one end thereof. Each positioner block 180 also has spaced first and second engagement surfaces 190 and 192, with second engagement surface 192 being longer than first engagement surface 190. A recess 194 separates first and second engagement surfaces 190 and 192.

First and second engagement surfaces 190 and 192 and recess 194 may be said to form a selective latch profile 195 which is adapted for engagement with latch profile 107 in sliding sleeve 66 of casing valve 24.

A pair of chamfers 196 and 198 are located on opposite ends of first engagement surface 190, and similarly, a pair of chamfers 200 and 202 are located on opposite ends of second engagement surface 192.

One or more hardened inserts 204 may be disposed in either or both of first and second engagement surfaces 190 and 192.

Generally speaking, engagement means 146 can be said to include separate first and second engagement means, namely the first and second pluralities of positioner blocks 152 and 180, respectively.

Locking means 148 comprises an upper annular wedge 206 and a lower annular wedge 208. Wedges 206 and 208 are substantially identical and may be symmetrical so that their orientation once positioned on inner positioning mandrel 112 is not critical.

Upper wedge 206 includes a tapered annular wedging surface 210 which is complementary to tapered locking surface 162 on positioner blocks 152, as seen in FIG. 3B. Upper wedge 206 is positioned on inner positioning mandrel 112 so that when the mandrel is moved downwardly using position control means 150, wedging surface 210 can be wedged against locking surfaces 162, as seen in FIG. 3B, thereby locking positioner blocks 152 in their radially outward position.

Lower wedge 208 has a similar annular wedging surface 212 which is complementary to locking surface 188 on positioner blocks 180 for locking positioner blocks 180 radially outwardly, as will be further described herein.

The position control means 150 includes a J-slot 214 defined in inner positioning mandrel 112, and a lug 216 connected to engagement means 146, with the lug being received in the J-slot. Generally speaking, J-slot 214 can be said to be defined in one of inner positioning mandrel 112 and engagement means 146, with the lug being connected to the other of inner positioning mandrel 112 and engagement means 146. J-slot 214 can be defined in engagement means 146, with the lug being connected to inner positioning mandrel 112.

The lower end of positioner body 158 is threadingly engaged with an upper body 218 and locked in position therewith by a set screw 220.

The lower end of upper body 218 is threadingly engaged with a lower body 222, and the upper and lower bodies are locked together by a set screw 224.

The lower end of lower body 222 is threadingly engaged with positioner body 184, and a set screw 226 locks them together.

A backup seal 228 provides wiping engagement between upper body 218 and inner positioning mandrel 112, and a similar or identical backup seal 230 provides wiping engagement between lower body 222 and mandrel 112.

It will thus be seen that J-slot lug 216 in the illustrated embodiment is generally connected to upper body 218. J-slot 214 is best seen in the laid-out view of FIG. 8. J-slot 214 is an endless J-slot.

Referring back to FIG. 3C, lug 216 is mounted in a rotatable ring 232 sandwiched between upper body 218 and lower body 222 with bearings 234 and 236 being located at the upper and lower ends, respectively, of rotatable ring 232. This permits lug 216 to rotate relative to J-slot 214 as inner positioning mandrel 112 is reciprocated or moves longitudinally relative to engagement means 146 so that lug 216 may traverse the endless J-slot 214.

J-slot 214 and lug 216 of position control means 150 interconnect inner positioning mandrel 112 and engagement means 146 and define at least in part a repetitive pattern of longitudinal positions of inner positioning mandrel 112 relative to engagement means 146 achievable upon longitudinal reciprocation of inner positioning mandrel 112 relative to engagement means 146. That repetitive pattern of positions is best illustrated with reference to FIG. 8 in which various positions of a lug 216 are shown in phantom lines.

Beginning with one of the positions designated as 216A, that position corresponds to a position in which upper annular wedge 206 would have its wedging surface 210 engaged with locking surface 162 of the first plurality of positioner blocks 152 to lock them in their radially outward position so that their latch profile 169 is engaged with latch profile 107 in sliding sleeve 66 so that the sliding sleeve may be moved downwardly within housing 50 to the closed position illustrated in FIGS. 2A–2C. Thus, positioner blocks 152 may be referred to as closing blocks. As is apparent in FIG. 8, in this first position 216A the position is not defined by positive engagement of lug 216 with an extremity of groove 214, but rather the position is defined by the engagement of upper wedge 206 with positioner blocks 152.

Figure 8:
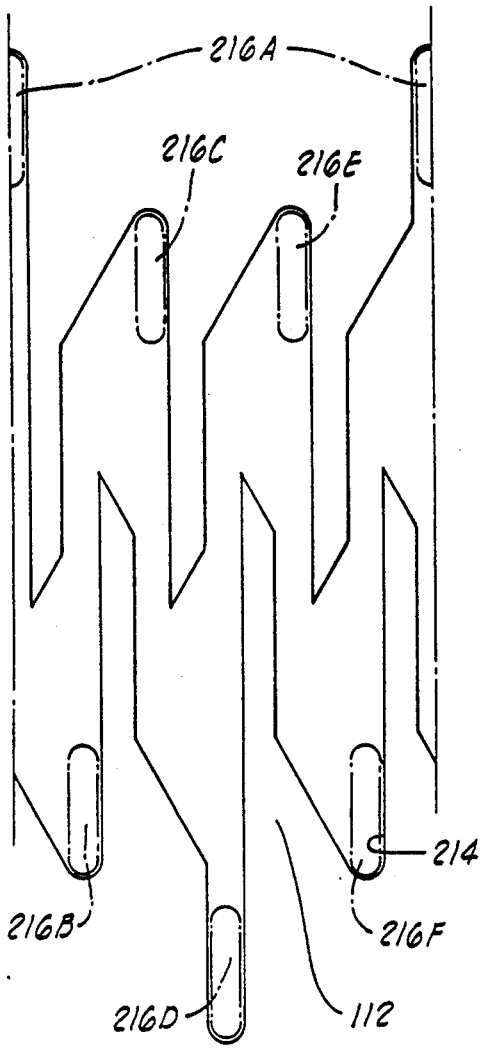
FIG. 8 is a laid-out view of a J-slot and lug means located in the first embodiment positioner tool and is viewed along lines 8—8 in FIGS. 3B and 3C.

By then pulling tubing string 36 and inner positioning mandrel 112 upwardly, with engagement means 146 being held in place by the engagement of positioner blocks 152 with sliding sleeve 66 because of the outward biasing of positioner blocks 152 by springs 160, J-slot 214 will be moved upwardly so that lug 216 traverses downwardly and over to the position 216B seen in FIG. 8. In position 216B, which can be referred to as an intermediate position, lug 216 is positively engaged with an extremity of J-slot 214 and allows engagement means 146 to be moved out of engagement with sliding sleeve 66 and upwardly in common with inner positioning mandrel 112.

The next downward stroke of inner positioning mandrel 112 relative to engagement means 146 moves lug 216 to position 216C which is another intermediate position in which lug 216 is positively engaged with another extremity of groove 214 so that inner positioning mandrel 112 and engagement means 146 may be moved downwardly together through casing string 12 and casing valve 24.

On the next upward stroke of inner positioning mandrel 112 relative to engagement means 146, lug 216 moves to position 216D which is in fact defined by engagement of wedging surface 212 of lower annular wedge 208 with locking surface 188 at the lower set of positioner blocks 180 so that they are locked outwardly with latch profile 195 thereof engaged with latch profile 107 in sliding sleeve 66. On this upward stroke, sleeve valve 66 can be pulled up to its open position. Thus, positioner blocks 180 can also be referred to as opening blocks.

The next downward movement of inner positioning mandrel 112 relative to engagement means 146 moves lug 216 to position 216E which is in fact a repeat of position 216C insofar as the longitudinal position of inner positioning mandrel 112 relative to engagement means 146 is concerned.

The next upper position of inner positioning mandrel 112 moves lug 216 to position 216F which is a repeat of position 216B insofar as longitudinal position of inner positioning mandrel 112 relative to engagement means 146 is concerned.

Then, the next downward motion of inner positioning mandrel 112 relative to engagement means 146 moves lug 216 back to position 216A in which the upper wedge 206 will engage upper positioning blocks 152 to lock them radially outwardly such that latch profile 169 of positioner blocks 152 is again in operable engagement with latch profile 107 in sliding sleeve 66 of casing valve 24.

Positioner tool 44 further includes an emergency release means 238 operatively associated with actuating means 148 for releasing engagement means 146 from the locked position thereof without moving inner positioning mandrel 112. This emergency release means 238 includes first and second sets of shear pins 240 and 242 connecting upper and lower wedges 206 and 208, respectively, to inner positioning mandrel 112. Shear pins 240 and 242 are designed to shear when sufficient force is applied thereto for releasing positioner tool 44 in the event that position control means 150 becomes disabled, as for example by jamming of lug 216 in J-slot 214.

FIRST EMBODIMENT JETTING TOOL

Jetting tool 46 can be generally described as an apparatus for hydraulically jetting a well tool such as casing valve 24 disposed in well 10.

The construction of jetting tool 46 is very much associated with that of positioning tool 44. When positioning tool 44 engages sliding sleeve 66 of casing valve 24 and moves it to an open position, the dimensions of positioning tool 44 and jetting tool 46 will cause jetting tool 46 to be appropriately aligned for hydraulically jetting through housing communication ports 56.

Jetting tool 46 can generally be described as a jetting means 46 connected to positioning tool 44 and forming a lower portion thereof.

Jetting tool 46 includes a jetting sub 244 connected to lower adapter 134 at threaded connection 246. A set screw 248 locks jetting sub 244 to lower adapter 134, and a sealing means, such as O-ring 250, provides sealing engagement therebetween.

Figure 3F:
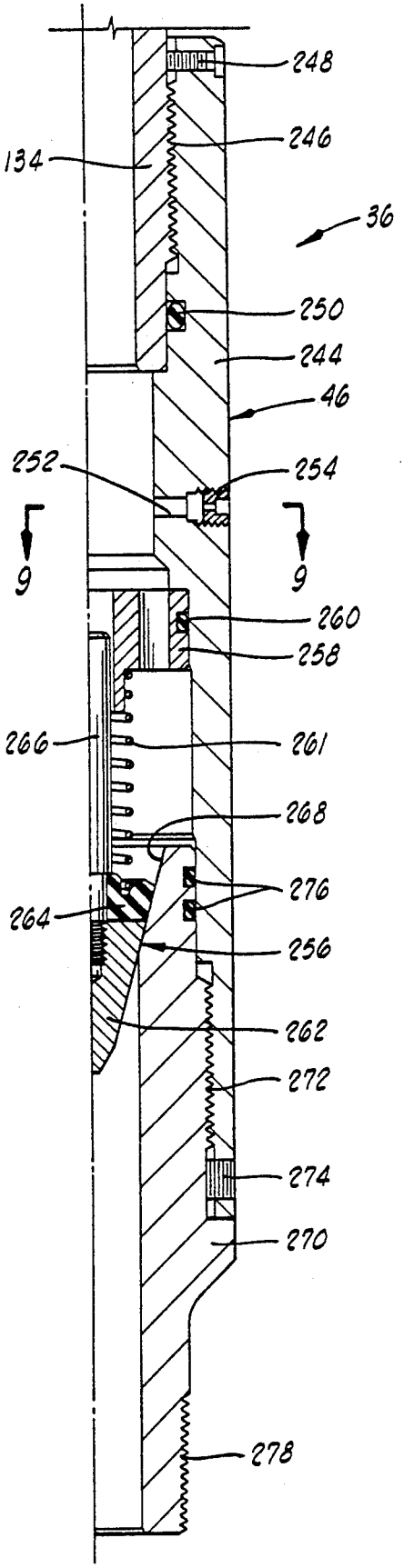
Figure 9:
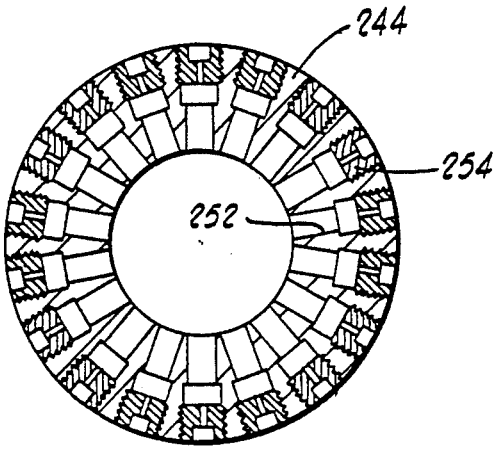
FIG. 9 is a cross-section taken along lines 9—9 in FIG. 3F.

Referring to FIGS. 3F and 9, a plurality of angularly spaced, radially oriented jetting ports 252 are defined in jetting sub 244. A plurality of replaceable jetting nozzles 254 are threadingly engaged with jetting sub 244, and each jetting nozzle 254 is substantially aligned with a corresponding jetting port 252. When jetting tool 246 is aligned with open casing valve 24 such that jetting nozzles 254 are longitudinally aligned with housing communication ports 56 in the casing valve, it is contemplated that at least one of jetting nozzles 254 will also be substantially radially aligned with a housing communication port such that fluid jetted from that jetting nozzle will be directed outwardly of casing valve 24 through the corresponding housing communication port 56. This is accomplished because the number of jetting nozzles 254 is great enough to provide a broad jetting pattern insuring at least some such alignment. Thus, jetting tool 46 may be used to jet through casing valve 24 without any rotation of the tool string being necessary.

In the embodiment of jetting tool 46 shown in FIG. 3F, the lower portion further includes a check valve means 256 of a kind known in the art. Check valve means 256 includes a spring seat 258 shouldered within jetting sub 244 with an O-ring 260 providing sealing engagement therebetween. A biasing means, such as spring 261, is provided for biasing a check valve 262 and an elastomeric seat seal 264 away from spring seat 258. A pilot pin 266 is threadingly engaged with check valve 262 and pilots within spring seat 258 to insure that check valve 262 and seal 264 are properly aligned.

Check valve 262 is tapered and engages a corresponding tapered surface 268 within a check valve body 270. Seat seal 264 sealingly engages tapered surface 268 when check valve means 266 is in the closed position illustrated.

Check valve body 270 is attached to jetting sub 244 at threaded connection 272. A set screw 274 locks check valve body 270 to jetting sub 244, and a sealing means, such as a pair of O-rings 276, provides sealing engagement between the jetting sub and check valve body. The lower end of check valve body 270 defines a threaded surface 278 which is adapted for connection to a lower tool string portion if desired.

Check valve means 256 permits tubing string 36 to fill while running into well 10, as well as permitting reverse circulation. It will be seen that check valve means 256 is self-centered to facilitate easy seating thereof when jetting tool 46 is in a horizontal position such as in the deviated portion 22 of well 10.

OPERATION OF THE FIRST EMBODIMENT

Use of casing valve 24 in highly deviated well bore portions 22 along with the tool string shown in FIGS. 3A-3F provides a system for the completion of highly deviated wells which will substantially reduce completion costs in such wells by eliminating perforating operations, and by eliminating the need for establishing zonal isolation through the use of packers and bridge plugs. In general, this system will provide substantial savings in rig time incurred during completion of the well.

The operation of the first embodiment is described herein as relating to wells that have the production string containing casing valves 24, 26 and 28 cemented in place. However, it should be understood that the invention is not necessarily so limited. The casing valves may also be used in uncemented completions wherein zonal isolation between the casing valves is established by external casing packers or the like. Also, the casing valves may be used in any cemented/uncemented combination.

Completion of well 10 utilizing this system begins with the cementing of production casing string 12 into well bore 14 with cement as indicated at 16. Particularly, the well is cemented across the zones of interest in which casing valves such as 24, 26 and 28 have been located prior to running casing string 12 into the well. With this system, a casing valve such as 24 is located at each point in which well 10 is to be stimulated adjacent some subsurface formation interest such as the subsurface formations 30, 32 and 34. These points of interest have been previously determined based upon logs of the well and other reservoir analysis data. Casing string or liner string 12 containing the appropriate number of casing valves 24 is centralized and cemented in place within well bore 14 utilizing acceptable practices for cementing in horizontal hole applications.

After cementing, a bit and stabilizer trip should be made to clean and remove as much as possible the residual cement laying on the bottom of casing 12 in horizontal section 22. The bit size utilized should be the largest diameter bit that could be passed safely through casing string 12. After cleaning out to total depth of the well by drilling out residual cement, the fluid in casing string 12 should be changed over to a filtered clear completion fluid suitable for use in completing the well if this has not already been done when displacing the final cement plug during the cementing process.

The next trip into the well is with tool string 36 of FIGS. 3A-3F including positioning tool 44, jetting tool 46 and wash tool 48, as is schematically illustrated in FIG. 1. In FIG. 1, this tool assembly is shown as it is being lowered into vertical portion 18 of well 10. The tool assembly will pass through radius portion 20 and into horizontal portion 22 of well 10. The tool assembly should first be run to just below the lowermost casing valve 28.

Then, hydraulic jetting begins utilizing a filtered clear completion fluid. The hydraulic jetting is performed with jetting tool 46 by pumping fluid down tubing string 36 and out jetting nozzles 254 to impinge casing bore 17. Jetting tool 46 is moved upwardly through casing valve 28 to remove any residual cement from all of the recesses in the internal portion of casing valve 28. This is particularly important when casing valve 28 is located in a deviated well portion because significant amounts of cement will be present along the lower inside surfaces of casing valve 28. This cement must be removed to insure proper engagement of positioning tool 44 with sleeve 66. During this jetting operation, positioning tool 44 should be indexed to one of its intermediate positions such as represented by lug positions 216B or 216F so that positioning tool 44 can move upwardly through casing valve 28 without locking engagement with sliding sleeve 66 of casing valve 28.

It is noted that when the terms "upward" or "downward" are used in the context of direction or movement in the well, these terms are used to mean movement along the axis of the well either uphole or downhole, respectively, which in many cases will not be exactly vertical and can in fact be horizontal in a horizontally oriented portion of the well.

Figure 4A:
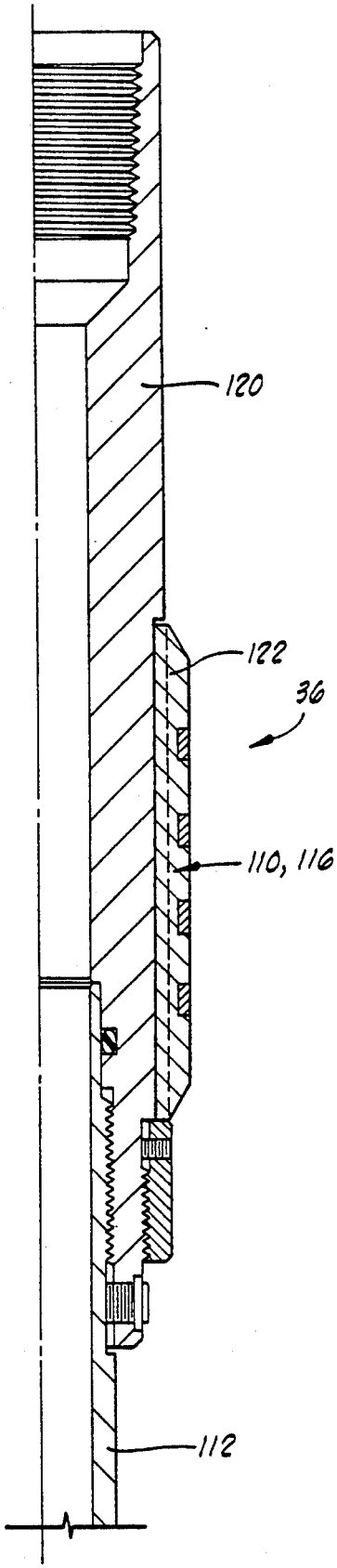
FIGS. 4A–4F comprise a sectioned view of the tool string of FIGS. 3A–3F in place within the casing valve of FIGS. 2A–2C. The sleeve is shown in its open position.
Figure 4B:
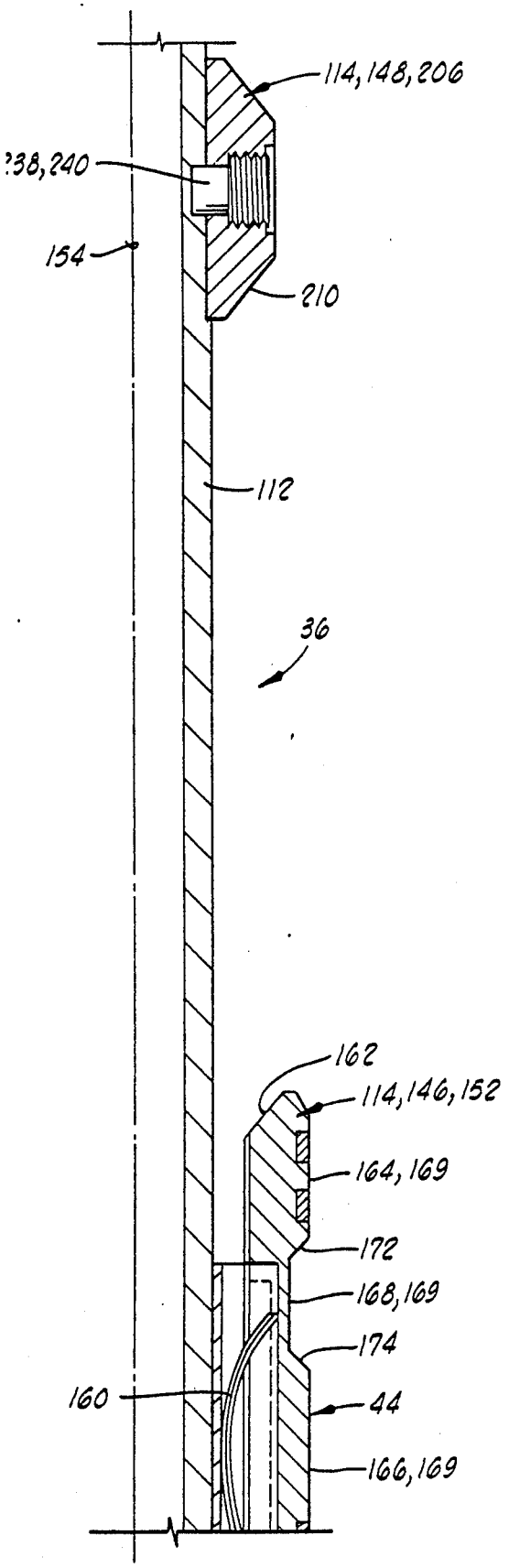
Figure 4C:
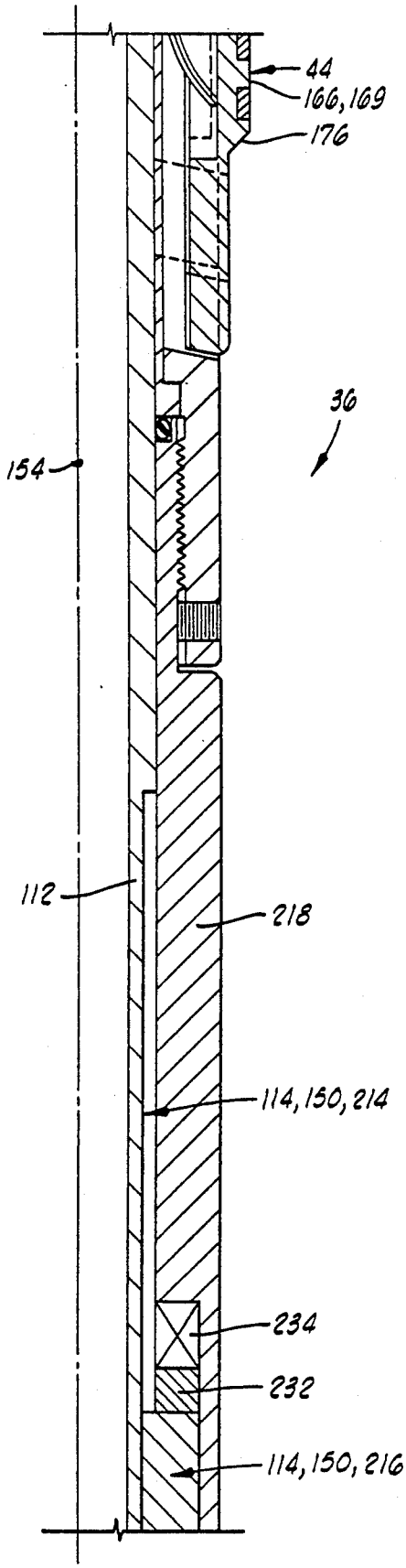
Figure 4D:
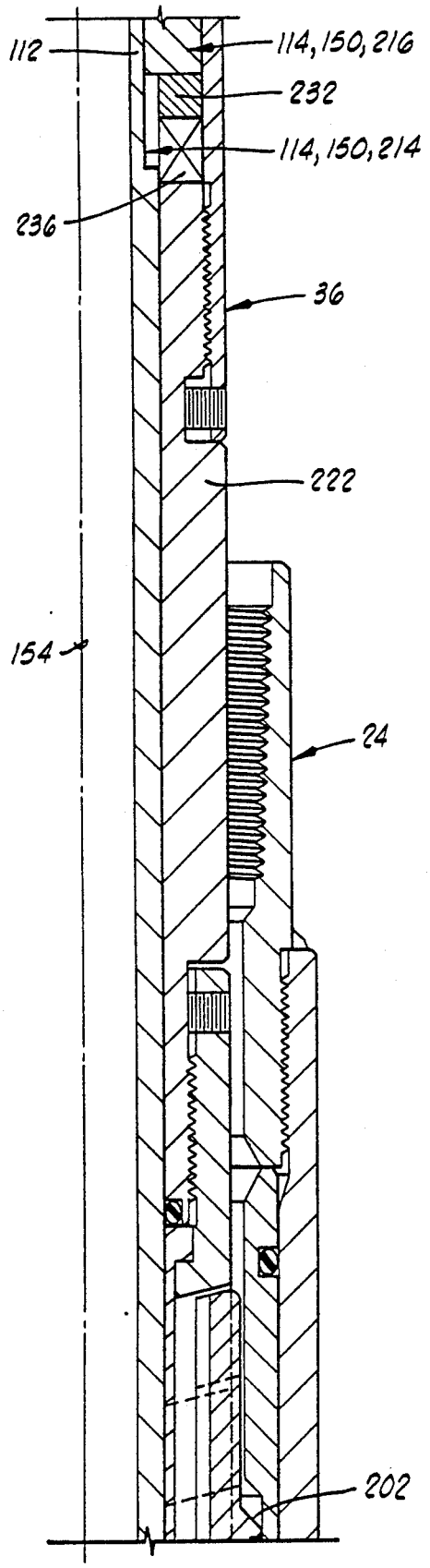
Figure 4E:
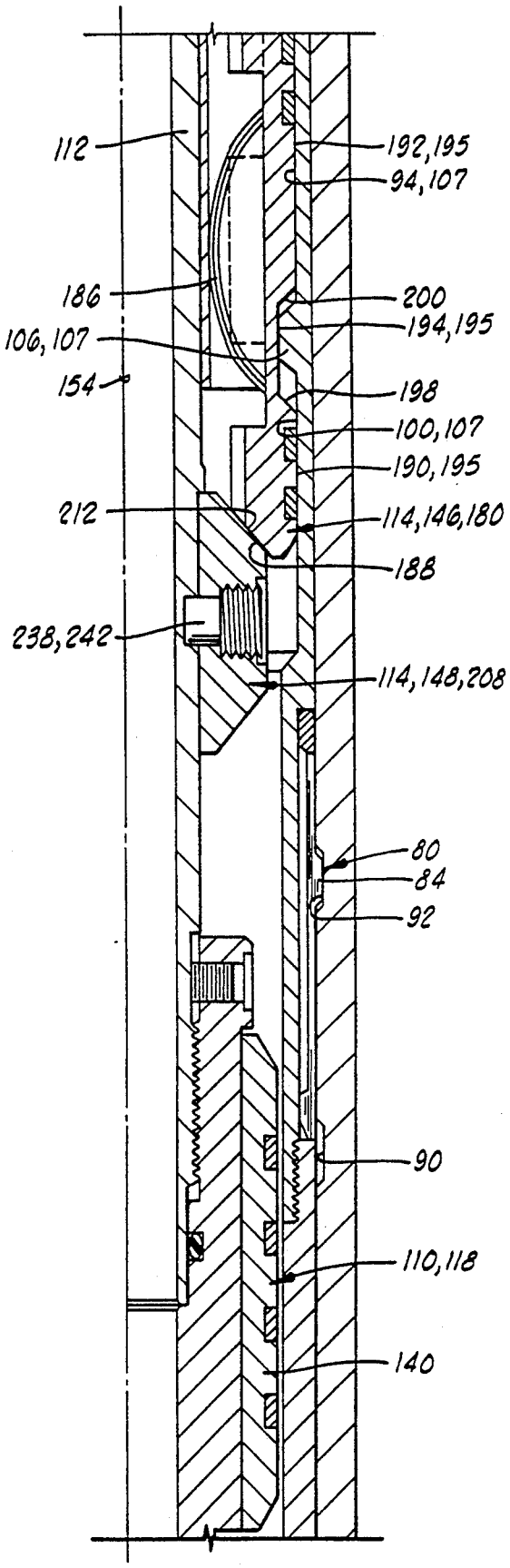

After hydraulically jetting the internal portion of casing valve 28, positioning tool 44 is lowered back through casing valve 28 and indexed to the position represented by lug position 216D. Positioning tool 44 is pulled upwardly so that lower wedge 208 engages lower positioner blocks 180 to lock them radially outwardly into the previously described engagement with sliding sleeve 66. Tubing string 36 is pulled upwardly to apply an upward force to sliding sleeve 66 of casing valve 28. Spring collet 84 is initially in engagement with first groove 90 of housing 50, and the upward pull will compress the collet to release first groove 90. As collet 84 compresses and releases, a decrease in upward force will be noted at the surface to evidence the beginning of the opening sequence. Sliding sleeve 66 will continue to be pulled to its full extent of travel which can be confirmed by a sudden rise in weight indicator reading at the surface as the top of sliding sleeve 66 abuts upper body 58 as shown in FIG. 4D. At this point, collet 84 will engage second groove 92 as shown in FIG. 4E.

Figure 4F:
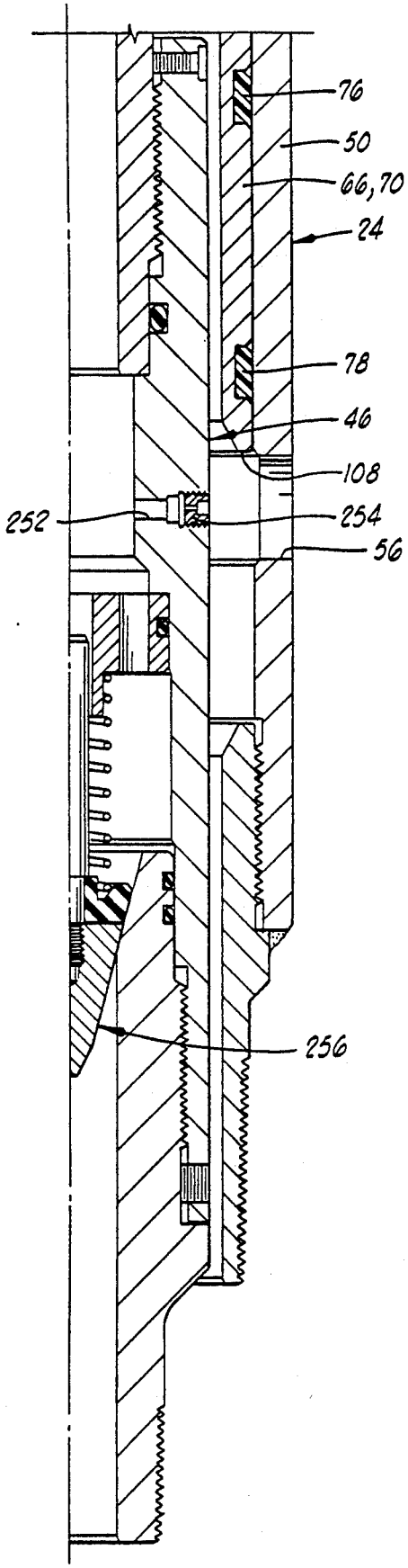

At this time, upward pull on the tubing string is reduced but an upward force is maintained on opening blocks 180. While maintaining the upward pull, and thus maintaining opening blocks 180 in locked engagement with sliding sleeve 66, as previously described, jetting is carried out. As seen in FIG. 4F, jetting nozzles 254 are longitudinally aligned with housing communication ports 56. High pressure fluid is pumped down through tubing string 36 and directed out of jetting nozzles 254. As previously described, at least one jetting orifice 254 will be substantially aligned with a corresponding housing communication port 56 as shown in FIG. 4F.

Once jetting in any pressure testing has been completed, positioning tool 44 is indexed to a position represented by lug position 216A wherein positioning mandrel 112 slides downwardly relative to operating means 114 until upper wedge 206 engages closing blocks 152 blocking the closing blocks outwardly into engagement with sliding sleeve 16 in casing valve 28. Then sufficient downward force is applied to sliding sleeve 66 to cause collet 84 to collapse and move out of engagement with upper groove 92. Sleeve 66 will then slide downwardly until collet 84 engages lower groove 90 and the valve is once again in the position shown in FIGS. 2A-2C.

If desired, blowout preventers 40 can be closed and the casing can be pressure tested to confirm that casing valve 28 is in fact closed.

Then, the tool string is moved upwardly to the next lowest casing valve, such as casing valve 26, and the sequence is repeated. After casing valve 26 has been treated in the manner just described, the tool string is again moved upwardly to the next lower casing valve, such as casing valve 24, until finally all of the casing valves have been hydraulically jetted to remove residual cement.

Once all of the casing valves have been jetted out and reclosed, the work string should be pulled up to the top of the liner, or to the top of deviated section 22 of casing 12 and backwashed. Backwashing is accomplished in a manner known in the art using wash tool 48.

SECOND EMBODIMENT CASING VALVE

Casing valve 24' which may also be referred to as a sliding sleeve casing tool apparatus 24' is shown in detail in FIGS. 5A-5D. Casing valve 24' includes an outer housing 300 having a longitudinal passageway 302 defined therethrough and having a side wall 304 with a plurality of housing communication ports 306 defined through the side wall. Housing communication ports 306 may be both longitudinally and circumferentially spaced.

Upper and lower bodies 308 and 310 are attached to the upper and lower ends of housing 300, respectively, to facilitate handling and makeup of sliding sleeve casing tool 24' into casing string 12'. Upper body 308 has an internal thread 312 for connection to an upper portion of casing string 12', and lower body 310 has an external thread 314 for connection to a lower portion of casing string 12'.

Casing valve 24' also includes a sliding sleeve 316 which comprises a collet sleeve 318 attached to a seal sleeve 320 at threaded connection 322. Sleeve 316 is disposed in longitudinal passageway 302 of housing 300 and is selectively movable relative to housing 300 between a first position shown in FIGS. 5A-5D blocking or covering housing communication ports 306 and a second position illustrated in FIGS. 7A-7G wherein housing communication ports 306 are aligned with corresponding sleeve communication ports 324 defined in seal sleeve 320 of sliding sleeve 316. Thus, housing communication ports 306 are placed in communication with longitudinal passageway 302, as will be further described herein.

Casing valve 24' includes an upper wiper 326 which provides wiping engagement between collet sleeve 318 and housing 300. Casing valve 24' also includes a lower seal 328 which provides sealing engagement between seal sleeve 320 and housing 300 below collet sleeve 318.

Casing valve 24' further includes a plurality of first and second port seals 330 and 332 which provide sealing engagement between seal sleeve 320 and housing 300. As shown in the closed position in FIGS. 5A-5D, a first port seal 330 is positioned above each housing communication port 306, and a second port seal 332 is positioned below each housing communication port 306. A second port seal 332 is disposed above each sleeve communication port 324, and a first port seal 330 is disposed below each sleeve communication port 324. Thus, both housing communication ports 306 and sleeve communication ports 324 have port seals on longitudinally opposite sides thereof.

A position latching means 334 is provided for releasably latching sliding sleeve 316 in its first and second positions. Position latching means 334 is disposed in an annulus 336 defined between sliding sleeve 316 and housing 300. It will be seen that annulus 336 is protected between upper wiper 326 and lower seal 328.

Position latching means 334 includes a spring collet 338, which may also be referred to as a spring biased latch means 338. Spring collet 338 is longitudinally positioned between upper end 340 of seal sleeve 320 of sliding sleeve 316 and downwardly facing shoulder 342 on collet sleeve 318 of sliding sleeve 316. Thus, collet 338 moves longitudinally with sliding sleeve 316 and may be considered to be attached thereto.

Position latching means 334 also includes first and second radially inwardly facing longitudinally spaced grooves 344 and 346 defined in housing 300 and corresponding to first and second positions, relatively, of sliding sleeve 316.

By placing spring collet 338 in annulus 336, the collet is protected in that cement, sand and the like are prevented from packing around the collet and impeding its successful operation.

It is noted that position latching means 334 could also be constructed by providing a spring latch attached to housing 50 and providing first and second grooves in sliding sleeve 316 rather than vice versa as they have been illustrated.

Sliding sleeve 316 has a longitudinal sleeve bore 348 defined therethrough. Collet sleeve 318 of sliding sleeve 316 defines a first radially inwardly facing groove 350 therein having upper and lower chamfers 352 and 354 at the upper and lower ends of groove 350, respectively. See FIG. 5A.

Figure 5A:
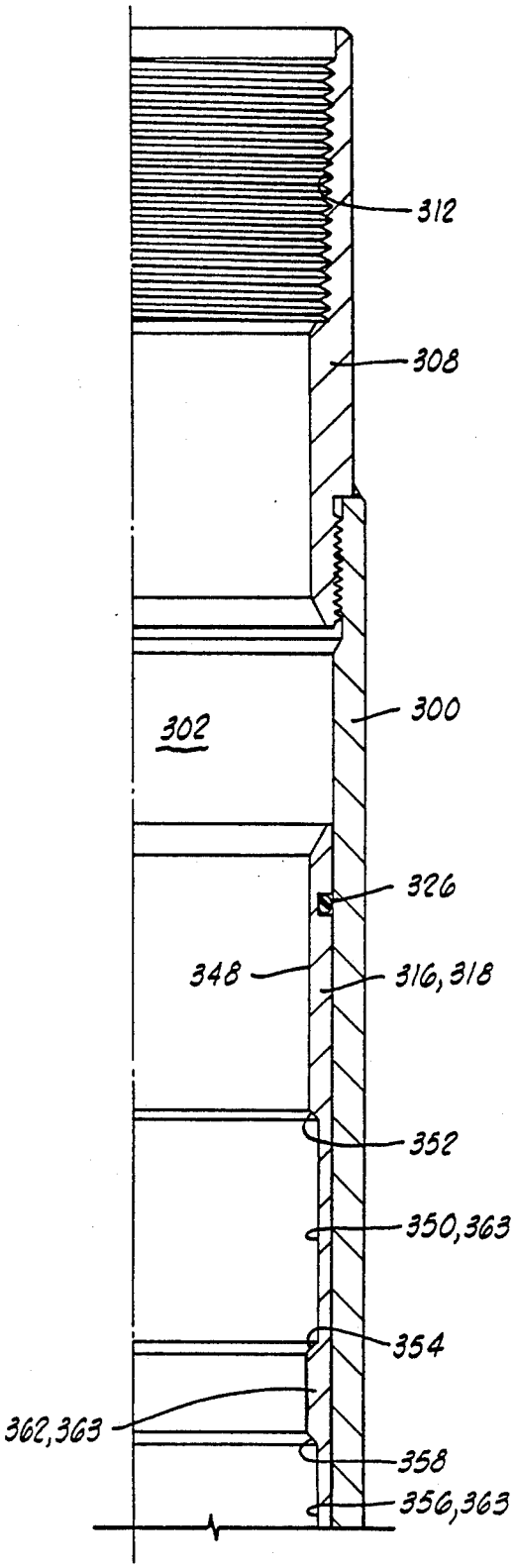
FIGS. 5A–5D present a cross section of the second embodiment of the casing valve of the present invention. The sleeve is shown in a closed position.
Figure 5B:
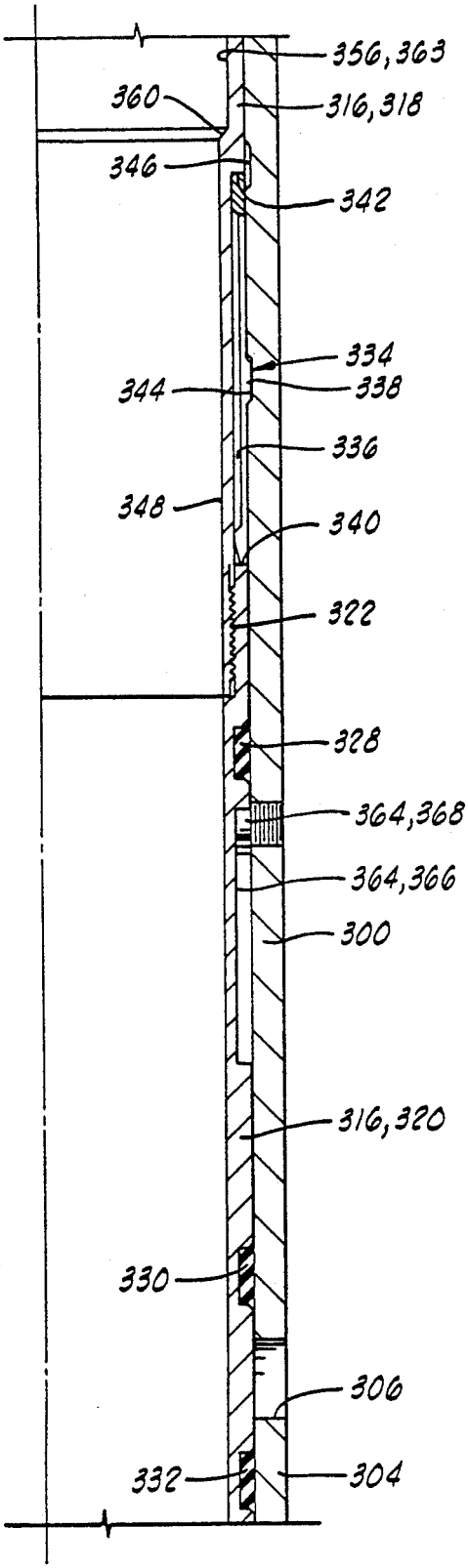
Figure 5C:
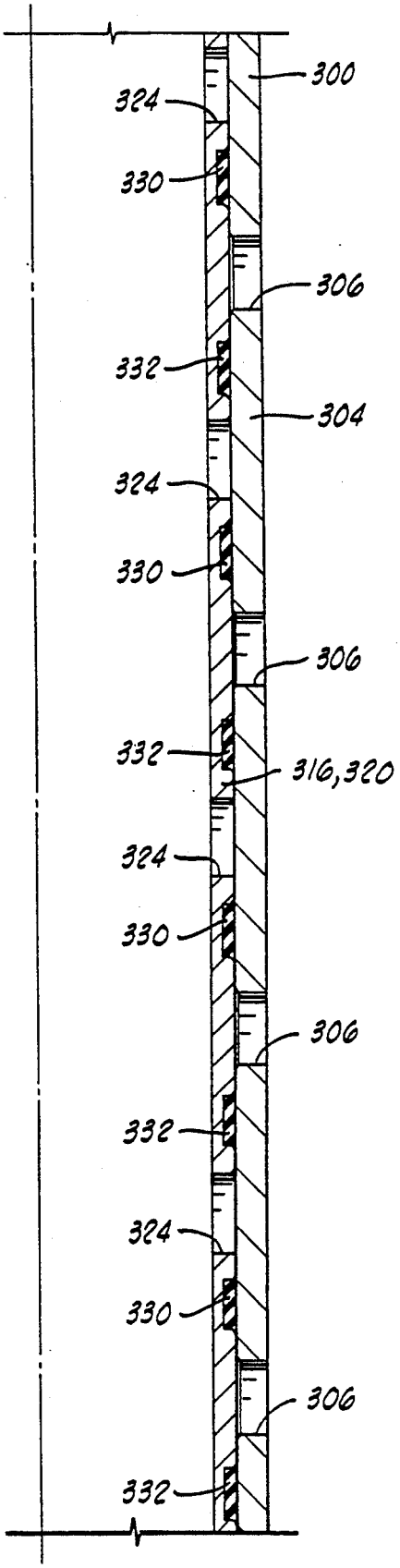
Figure 5D:
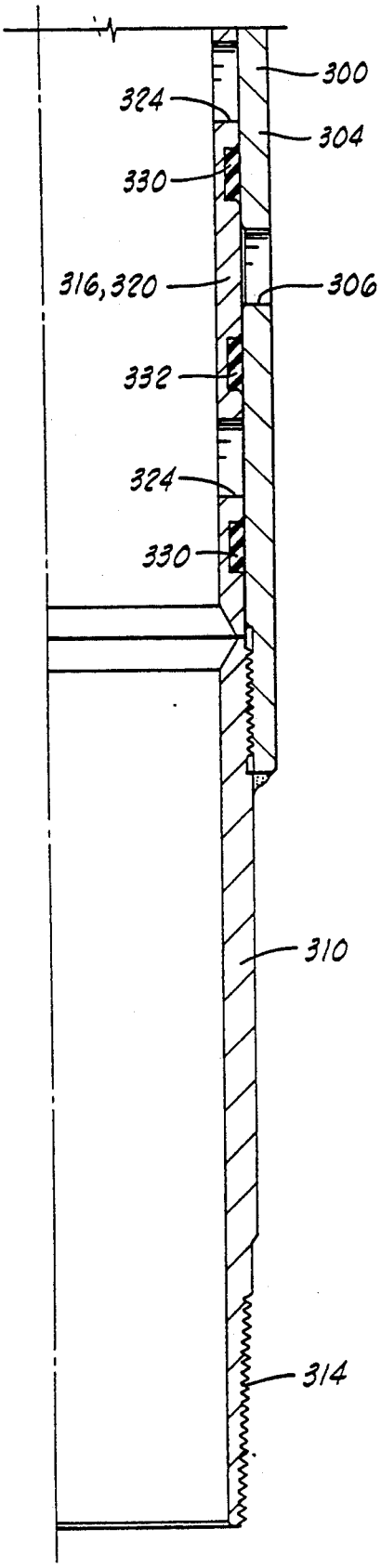

Spaced below first groove 94, collet sleeve 318 defines a second radially inwardly facing groove 356 therein having upper and lower chamfers 358 and 360 at the upper and lower ends thereof, respectively, as seen in FIGS. 5A and 5B.

It may be said that first groove 350 and second groove 356 are separated by a ring or shoulder portion 362 in collet sleeve 318 of sliding sleeve 316.

First and second grooves 350 and 356 and ring 362 therebetween may be said to form a latch profile 363 adapted for engagement by positioning tool 44', as will be further described herein.

An alignment means 364 is operably associated with housing 300 in sliding sleeve 316 for maintaining sleeve communication ports 324 in registry with corresponding housing communication ports 306 when sleeve 316 is in its second position with spring collet 338 engaging groove 346. Alignment means 364 includes a longitudinal guide groove 366 defined in seal sleeve 320 of sliding sleeve 316 and a corresponding guide lug extending from housing 300 and received in groove 366.

Alignment means 364 is positioned within a sealed annulus defined between lower seal 328 and the uppermost first port seal 330.

It is noted that casing valve 24' could also be constructed so as to have lugs or pins attached to sliding sleeve 316 and received in longitudinal grooves defined in housing 300 in order to provide alignment between housing communication ports 306 and sleeve communication ports 324.

It will be seen that sliding sleeve 316 of casing valve 24' has a relatively short sleeve travel as compared to sliding sleeve type casing valves of the prior art, even shorter than that in the casing valve of Brandell disclosed in U.S. Pat. No. 4,991,654, which itself has a sleeve travel shorter than other prior art casing valves. In the present invention, each sleeve communication port is spaced only slightly downwardly from the corresponding housing communication port, and only a short travel is required to align the housing and sleeve communication ports. This is unlike the prior art in which all of the sleeve communication ports were positioned below all of the housing communication ports when the casing valve is closed.

SECOND EMBODIMENT POSITIONING TOOL

Referring now to FIGS. 6A–6G, a portion of tubing string 36' is shown made up of positioning tool 44' and jetting tool 46'. These same components are shown in place within casing valve 24' in FIGS. 7A–7G.

Positioning tool 44' is similar to positioning tool 44 of the first embodiment and may be generally described as a positioning tool apparatus for positioning a sliding member of a well tool, such as sliding sleeve 316 of casing valve 24'.

The primary components of positioning tool apparatus 44' are a guide means 370, an inner positioning mandrel 372 and an operating means 374.

Figure 6A:
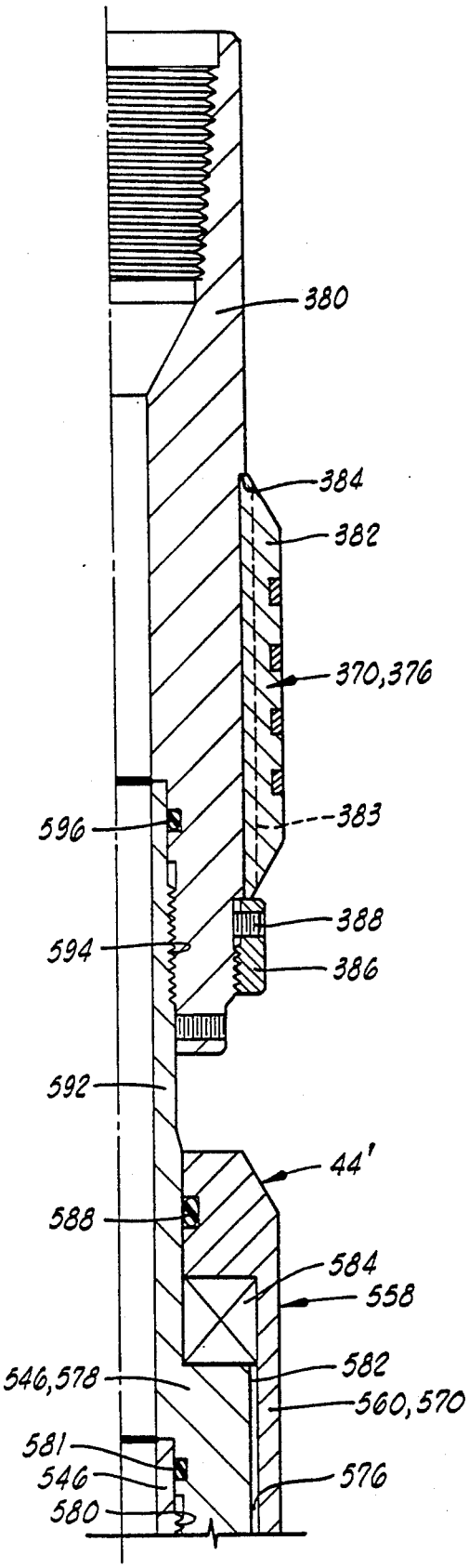
FIGS. 6A–6G show a cross section of the second embodiment of the tool string of the present invention showing a second embodiment positioner tool and second embodiment jetting tool.
Figure 6B:
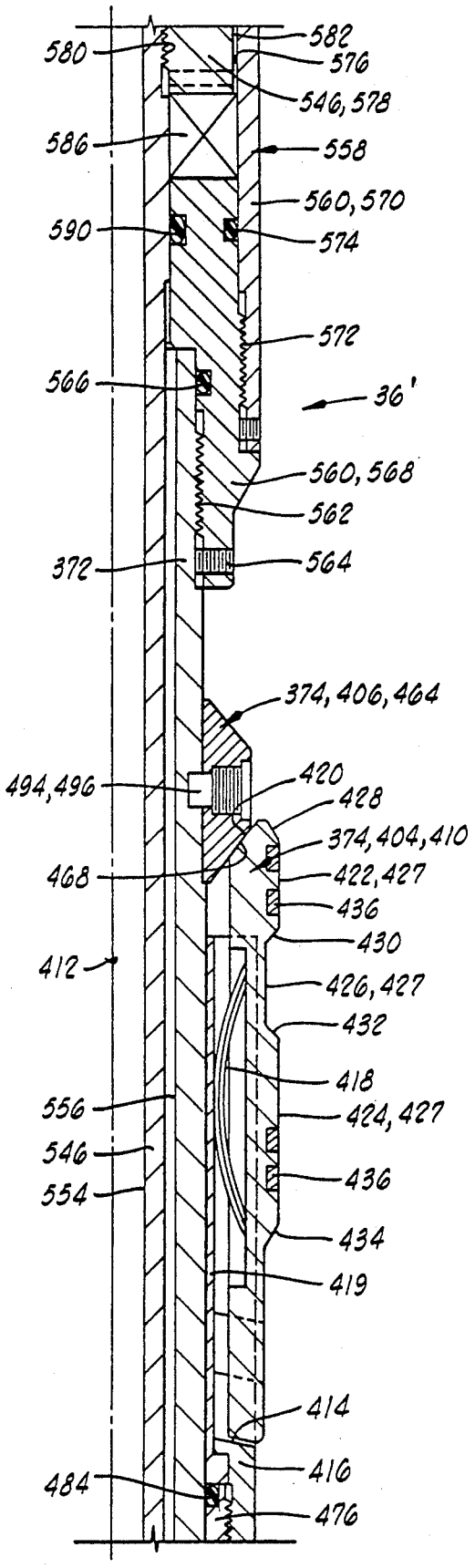
Figure 6C:
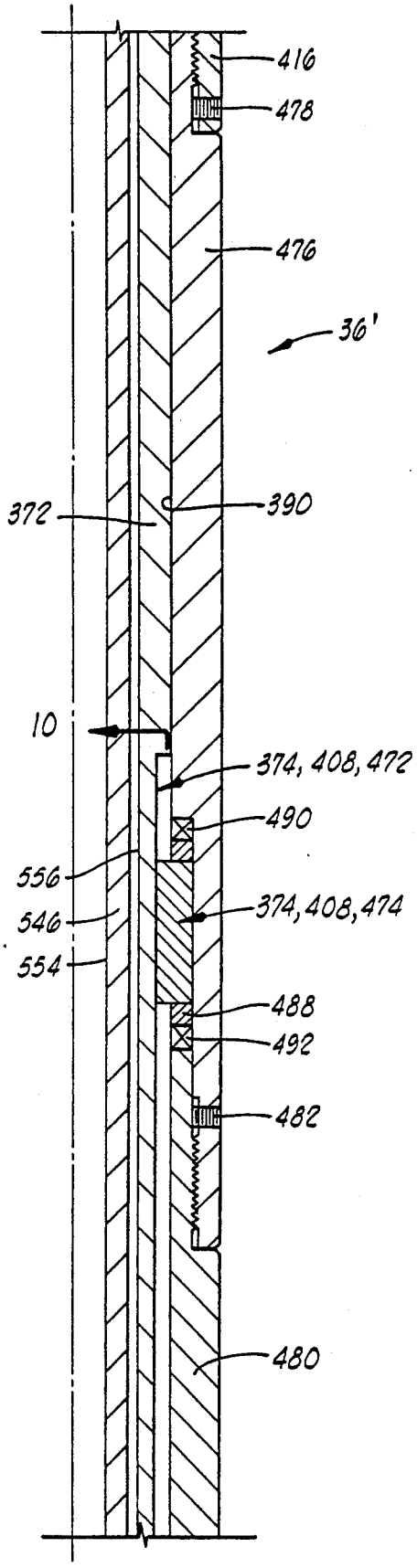
Figure 6D:
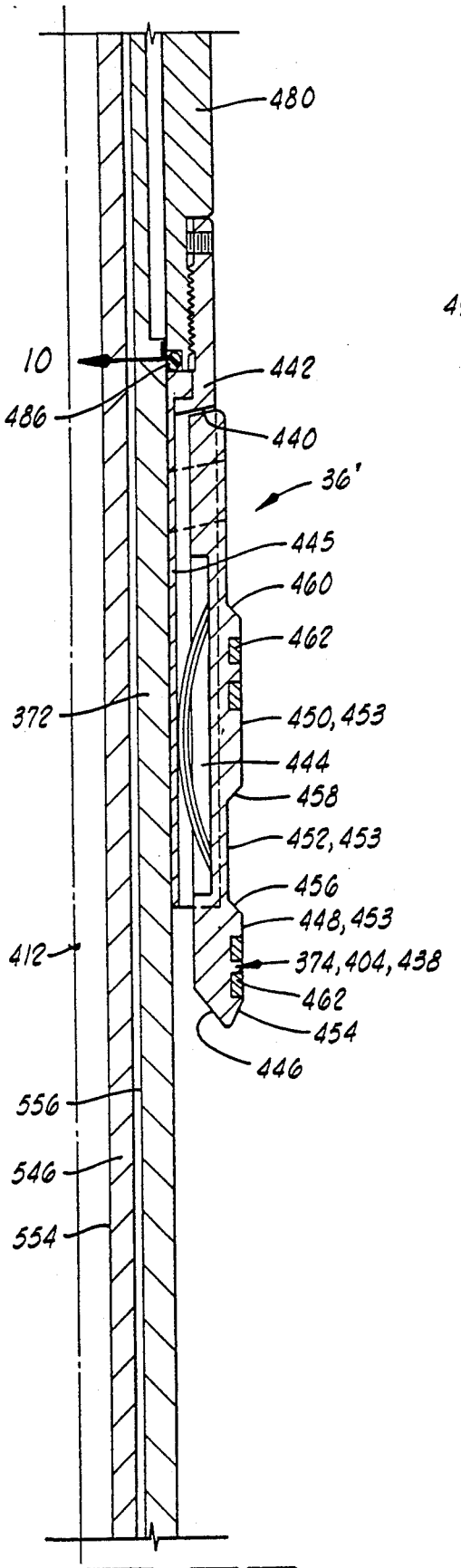
Figure 6E:
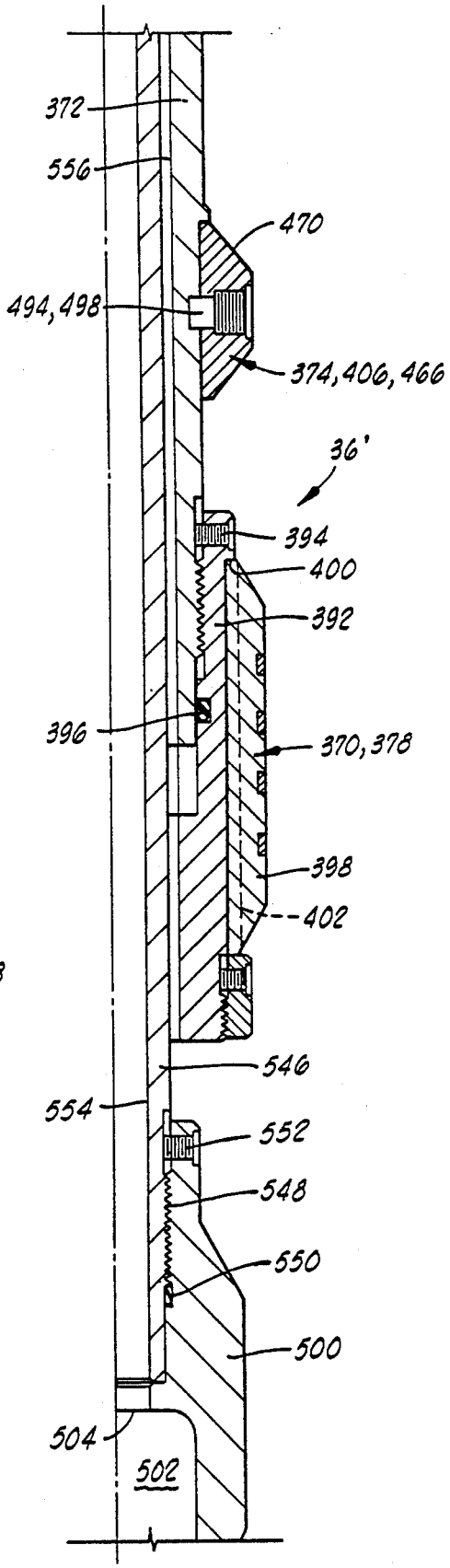

Guide means 370 includes an upper guide assembly 376 shown in FIG. 6A and a lower guide assembly 378 shown in FIG. 6E.

Upper guide assembly 376 includes an upper adapter 380 with a star guide assembly 382, which has a plurality of flats 383, disposed thereon adjacent to a shoulder 384 on the upper adapter. Star guide assembly 382 is held in position by a star guide retainer which is threaded to upper adapter 380. A set screw 388 may be used to lock retainer 386 in place.

Inner positioning mandrel 372 is disposed through a longitudinal passageway 390 of operating means 374 and is longitudinally movable relative to operating means 374. That is, inner positioning mandrel 372 can slide up and down within longitudinal passageway 390.

Lower guide assembly 378 of guide means 370 includes a lower adapter 392 which is threadingly engaged by the lower end of inner positioning mandrel 372. A set screw 394 locks mandrel 372 and lower adapter 392 together. An O-ring seal 396 provides sealing engagement therebetween.

A star guide assembly 398 is disposed on lower adapter 392 adjacent to shoulder 400 on the lower adapter. Star guide assembly 398 is preferably substantially the same as star guide assembly 382 and has a plurality of flats 402 thereon.

Operating means 374 provides a means for selectively operably engaging sliding sleeve 316 of casing valve 24' in response to longitudinally reciprocating motion of inner positioning mandrel 372. More particularly, operating means 374 includes an engagement means 404 slidably disposed on inner positioning mandrel 372 for operably engaging sliding sleeve 316 of casing valve 24'. Operating means 374 also includes a locking means 406 connected to inner positioning mandrel 372 for locking engagement means 404 into operable engagement with sliding sleeve 316 of casing valve 24'. Operating means 374 further includes a position control means 408 operably associated with engagement means 404 and inner positioning mandrel 372 for permitting the mandrel to reciprocate longitudinally relative to engagement means 404 and selectively lock and unlock engagement means 404 with locking means 406.

Engagement means 404 includes a first plurality of positioner blocks 410 circumferentially spaced about a longitudinal axis 412 of positioner tool 44' and inner positioning mandrel 372. Each positioner block 410 is disposed in a window 414 of a positioner body 416. A biasing means, such as a plurality of springs 418 engaging inner positioning mandrel 372, biases each positioner block 410 radially outwardly. A spring sleeve 419 is disposed between inner positioning mandrel 372 and springs 418 so that the springs do not drag on the inner positioning mandrel.

At the upper end of each positioner block 410 is a tapered locking surface 420. Each positioner block 410 also has a first engagement surface 422 and a second engagement surface 424, spaced from first engagement surface 422, facing radially outwardly thereon. First and second engagement surfaces 422 and 424 are separated by a recess 426.

First and second engagement surfaces 422 and 424 and recess 426 therebetween may be said to form a selective latch profile 427 which is adapted for engagement with latch profile 363 in sliding sleeve 360 of casing valve 24', as will be further described herein.

A pair of chamfers 428 and 430 are located at opposite ends of first engagement surface 422, and similarly, chamfers 432 and 434 are located on opposite ends of second engagement surface 424.

Either or both of first and second engagement surfaces 422 and 424 may have hardened inserts 436 therein.

Engagement means 374 further includes a second plurality of positioner blocks 438 similarly located around axis 412. Each positioner block 438 is disposed in a window 440 of a positioner body 442. In the preferred embodiment, positioner blocks 438 are identical to positioner blocks 410. A biasing means, such as spring 444 engaging inner positioning mandrel 372, biases each positioner block 438 radially outwardly. A spring sleeve 445 is disposed between inner positioning mandrel 372 and springs 444 so that the springs do not drag on the inner mandrel.

Each positioner block 438 has a locking surface 446 at one end thereof. Each positioner block 438 also has spaced first and second engagement surfaces 448 and 450, with second engagement surface 450 being longer than first engagement surface 448. A recess 452 separates first and second engagement surfaces 448 and 450. First and second engagement surfaces 448 and 450 and recess 452 therebetween may be said to form a selective latch profile 453 which is adapted for engagement with latch profile 363 in sliding sleeve 316 of casing valve 24'.

A pair of chamfers 454 and 456 are located on opposite ends of first engagement surface 448, and similarly, a pair of chamfers 458 and 460 are located on opposite ends of second engagement surface 450.

One or more hardened inserts may be disposed in either or both of first and second engagement surfaces 448 and 450.

Generally speaking, engagement means 404 can be said to include separate first and second engagement means, namely the first and second pluralities of positioner blocks 410 and 438, respectively.

Locking means 406 comprises an upper annular wedge 464 and a lower annular wedge 466. Wedges 464 and 466 are substantially identical and are symmetrical so that their orientation once positioned on inner positioning mandrel 372 is not critical.

Upper wedge 464 includes a tapered annular wedging surface 468 which is complementary to locking surface 420 on positioner blocks 410, as seen in FIG. 6B. Upper wedge 464 is positioned on inner positioning mandrel 372 so that when the mandrel is moved downwardly using position control means 408, wedging surface 468 can be wedged against locking surface 420, as seen in FIG. 6B, thereby locking positioner blocks 410 in their radially outward position.

Lower wedge 466 has a similar annular wedging surface 470 which is complementary to locking surface 446 on positioner blocks 438 for locking positioner blocks 438 radially outwardly, as will be further discussed herein.

The position control means 408 includes a J-slot 472 defined in inner positioning mandrel 372, and a lug 474 connected to engagement means 404, with the lug being received in the J-slot. Generally speaking, J-slot 472 can be said to be defined in one of inner positioning mandrel 372 and engagement means 404, with the lug being connected to the other of inner positioning mandrel 372 and engagement means 404. J-slot 472 can be defined in engagement means 404 with the lug being connected to inner positioning mandrel 372.

The lower end of positioner body 416 is threadingly engaged with an upper body 476 and is locked in position therewith by a set screw 478.

The lower end of upper body 476 is threadingly engaged with a lower body 480, and a set screw 482 locks them together.

A backup seal 484 provides wiping engagement between upper body 476 and inner positioning mandrel 372, and a similar or identical backup seal 486 provides wiping engagement between lower body 480 and inner positioning mandrel 372.

It will thus be seen that J-slot lug 474 in the illustrated embodiment is generally connected to upper body 476. J-slot 472 is best seen in the laid-out view in FIG. 10. J-slot 472 is an endless J-slot.

Referring back to FIG. 6C, lug 474 is mounted in a rotatable ring 488 sandwiched between upper body 476 and lower body 480 with bearings 490 and 492 being located at the upper and lower ends, respectively, of rotatable ring 492. This permits lug 474 to rotate relative to J-slot 472 as inner positioning mandrel 372 is reciprocated or moves longitudinally relative to engagement means 404 so that lug 474 may traverse the endless J-slot 472.

J-slot 472 and lugs 474 of position control means 408 interconnect inner positioning mandrel 372 and engagement means 404 and define at least in part a repetitive pattern of longitudinal positions of inner positioning mandrel 372 relative to engagement means 404 achievable upon longitudinal reciprocation of inner positioning mandrel 372 relative to engagement means 404. That repetitive pattern of positions is best illustrated with reference to FIG. 10 in which the various positions of lug 474 are shown in phantom lines.

Beginning with one of the positions designed as 474A, that position corresponds to a position in which upper annular wedge 464 would have its wedging surface 468 engaged with locking surface 420 of the first plurality of positioner blocks 410 to lock them in their radially outward positions so that their latch profile 427 is engaged with latch profile 363 and sliding sleeve 316 so that the sliding sleeve may be moved downwardly within housing 300 to the closed position shown in FIGS. 5A-5D. Thus, positioner blocks 410 may be referred to as closing blocks. As is apparent in FIG. 10, in this first position 474A, the position is not defined by positive engagement of lug 474 with an extremity of groove 472, but rather the position is defined by the engagement of upper wedge 464 with positioner blocks 410.

Figure 10:
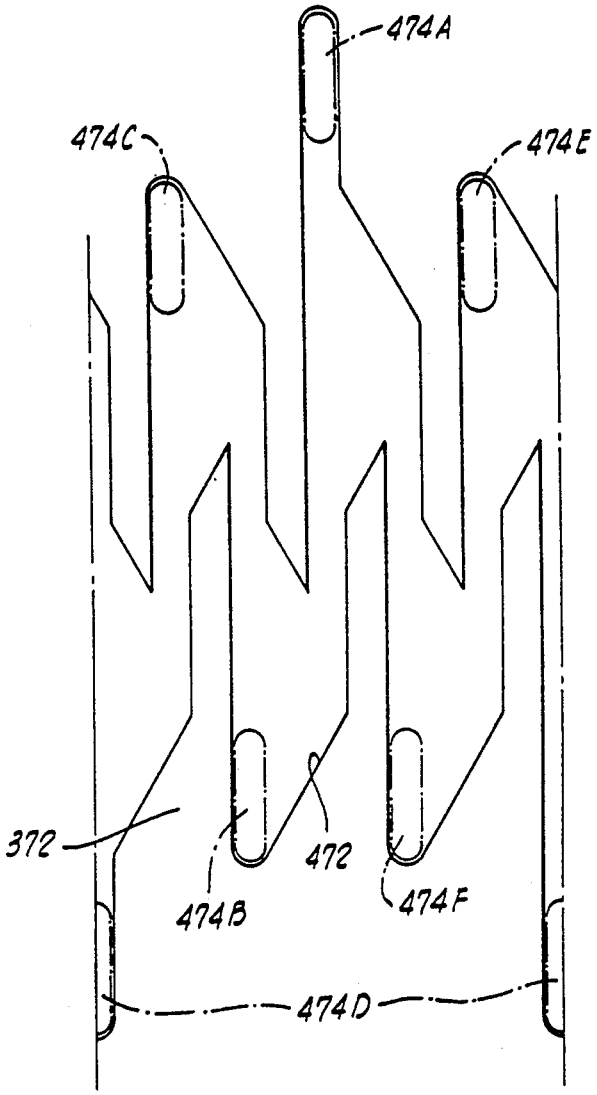
FIG. 10 is a laid-out view of a J-slot and lug means in the second embodiment positioner tool and is viewed along lines 10—10 in FIGS. 6C and 6D.

By then pulling tubing string 36' and inner positioning mandrel 372 upwardly with engagement means 404 being held in place by the engagement of positioner blocks 410 with sliding sleeve 316 because of the outward biasing of positioner blocks 410 by springs 418, J-slot 472 will be moved upwardly so that lug 474 traverses downwardly and over to position 474B seen in FIG. 10. In position 474B, which can be referred to as an intermediate position, lug 474 is positively engaged with an extremity of slot 472 and allows engagement means 404 to be moved out of engagement with sliding sleeve 316 and upwardly in common with inner positioning mandrel 372.

The next downward stroke of inner positioning mandrel 372 relative to engagement means 404 moves lug 474 to position 474C which is another intermediate position in which lug 474 is positively engaged with another extremity of groove 472 so that inner positioning mandrel 372 and engagement means 404 may be moved downwardly together through casing string 12' and casing valve 24'.

On the next upward stroke of inner positioning mandrel 372 relative to engagement means 404, lug 474 moves to position 474D which is in fact defined by engagement of wedging surface 470 of lower annular wedge 466 with locking surface 446 at the lower set of positioner blocks 438 so that they are locked outwardly with latch profile 453 thereof engaged with latch profile 363 in sliding sleeve 316. On this upward stroke, sleeve 316 can be pulled to its open position. Thus, positioner blocks 438 can also be referred to as opening blocks.

The next downward movement of inner positioning mandrel 372 relative to engagement means 404 moves lug 474 to position 474E which is in fact a repeat of position 474C insofar as the longitudinal position of inner positioning mandrel 372 relative to engagement means 404 is concerned.

The next upper position of inner positioning mandrel 372 moves lug 474 to position 474F which is a repeat of 474B insofar as longitudinal position of inner positioning mandrel 372 relative to engagement means 404 is concerned.

Then, the downward motion of inner positioning mandrel 372 relative to engagement means 404 moves lug 474 back to position 474A in which upper wedge 464 will engage upper positioner blocks 410 to lock them radially outwardly such that latch profile 427 of positioner blocks 410 is again in operable engagement with latch profile 363 in sliding sleeve 316 of casing valve 24'.

Positioner tool 44' further includes an emergency release means 494 operatively associated with actuating means 406 for releasing engagement means 404 from the locked position thereof without moving inner mandrel 372. This emergency release means 494 includes first and second sets of shear pins 496 and 498 connecting upper and lower wedges 464 and 466, respectively, to inner positioning mandrel 372. Shear pins 496 and 498 are designed to shear when sufficient force is applied thereto for releasing positioner tool 44' in the event that position control means 408 becomes disabled, as for example by jamming of lug 474 in J-slot 472.

SECOND EMBODIMENT JETTING TOOL

Jetting tool 46' can be generally described as an apparatus for hydraulically jetting a well tool such as casing valve 24' disposed in well 10.

The construction of jetting tool 46' is very much associated with that of positioning tool 44'. When positioning tool 44' engages sliding sleeve 316 of casing valve 24' and moves it to an open position, the dimensions of positioning tool 44' and jetting tool 46' will cause jetting tool 46' to be approximately aligned for hydraulically jetting through aligned sleeve communication ports 324 and housing communication ports 306.

Jetting tool 46' can generally be described as a jetting means 46' connected to positioning tool 44' and forming a lower portion thereof.

Jetting tool 46' includes a jetting sub 500 having a chamber 502 defined therein with upper and lower ends 504 and 506, respectively. Jetting sub 500 has a peripheral wall 508 with a plurality of jetting orifices 510 defined therethrough and communicated with chamber 502. Each of jetting orifices 510 is actually defined in a threaded insert 512 set in a recessed portion 514 of a cylindrical outer surface 516 of jetting sub 500.

Figure 6F:
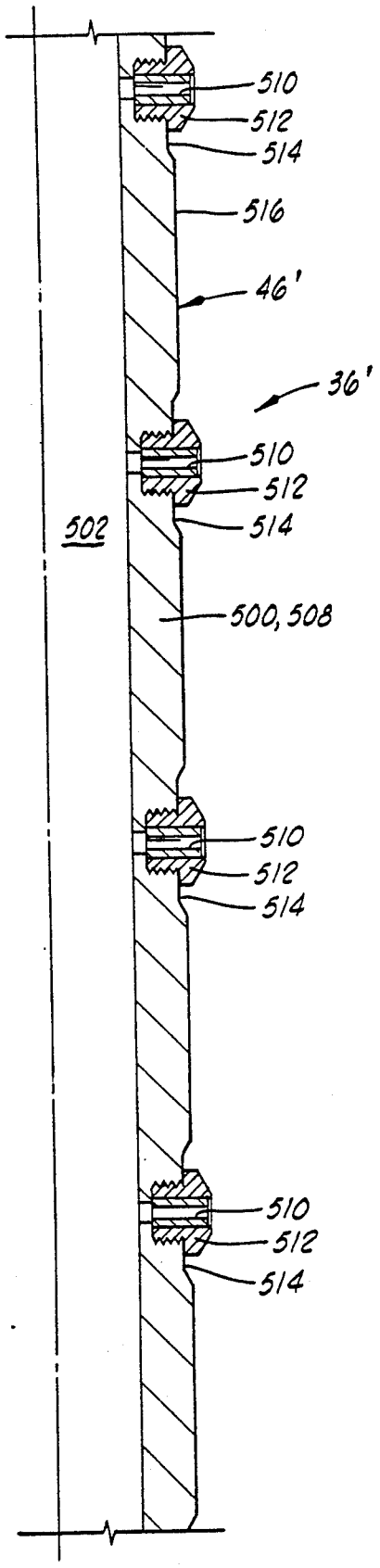
Figure 6G:
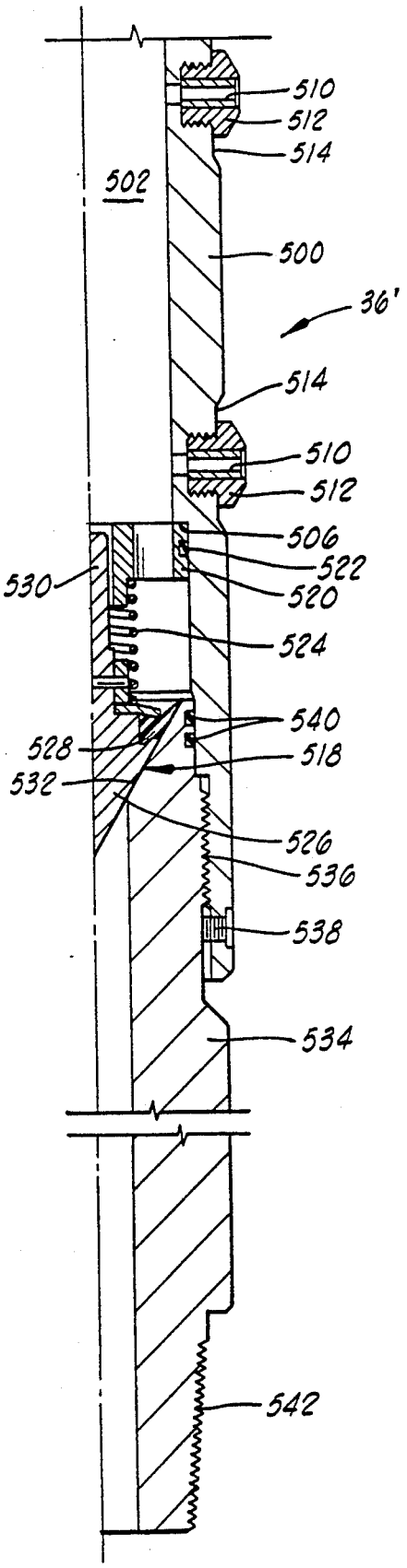
Figure 7A:
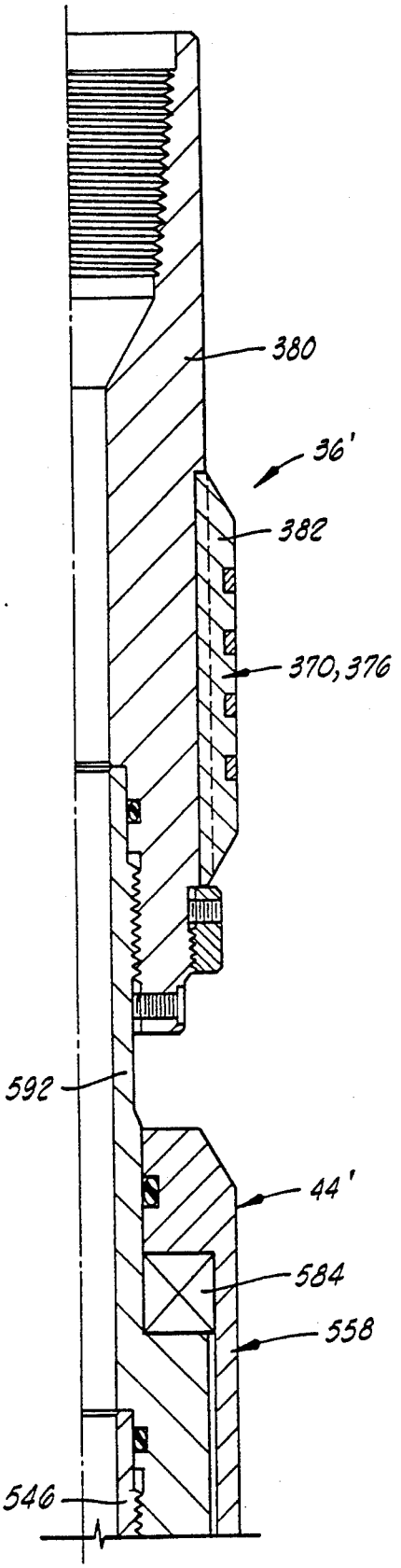
FIGS. 7A–7G show a cross-sectional view of the tool string of FIGS. 6A–6G in place within the casing valve of FIGS. 5A–5D, The sleeve is shown in its open position.
Figure 7B:
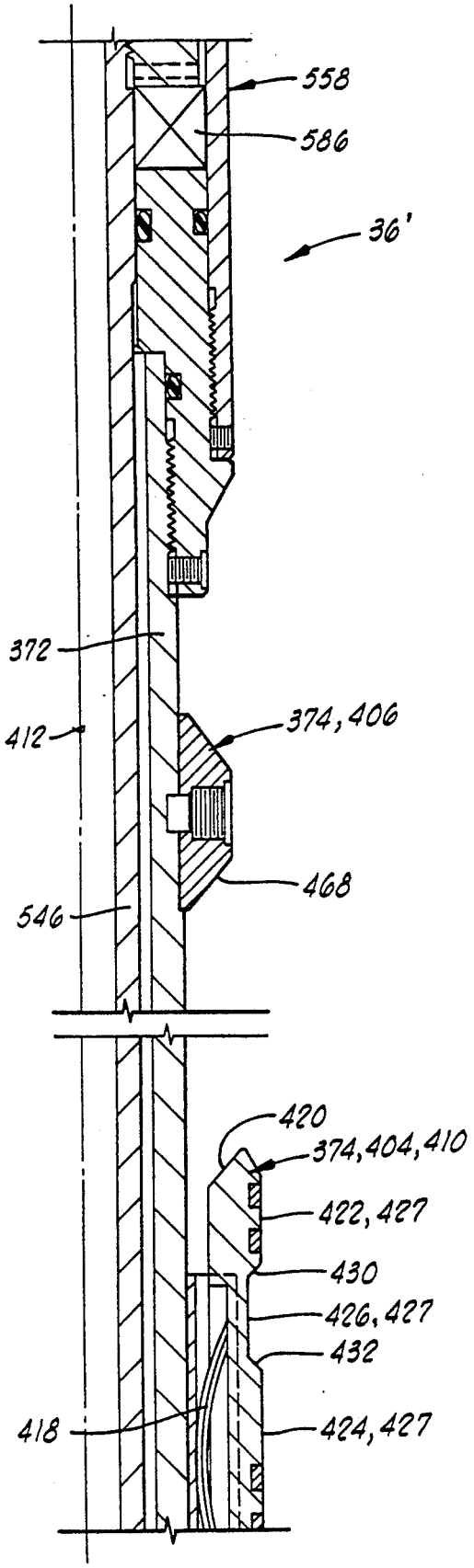
Figure 7C:
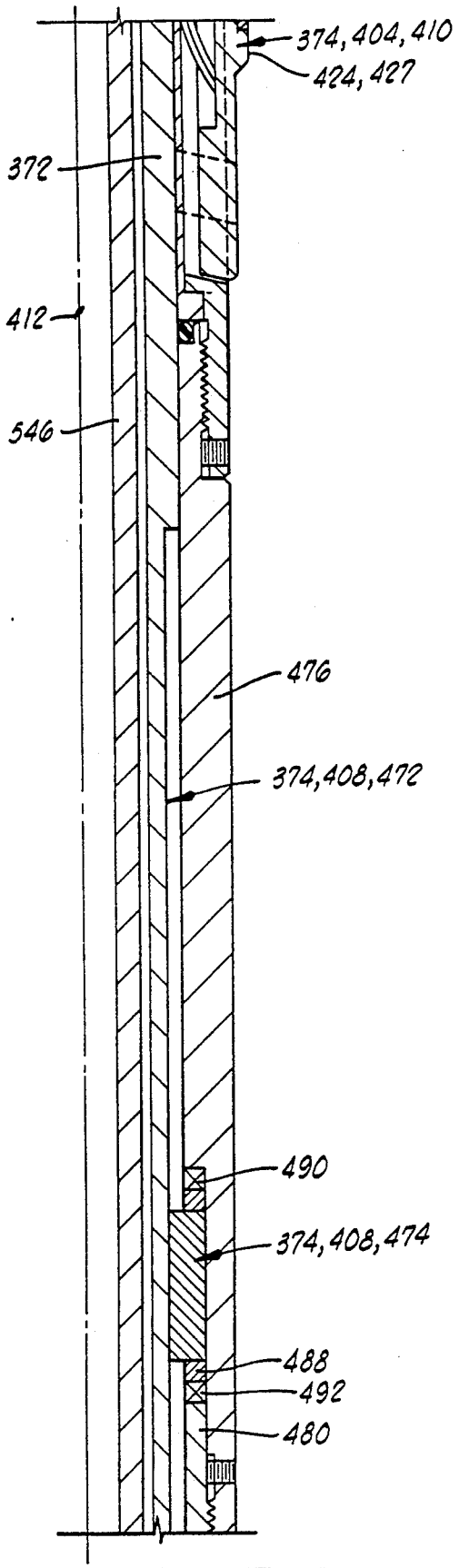
Figure 7D:
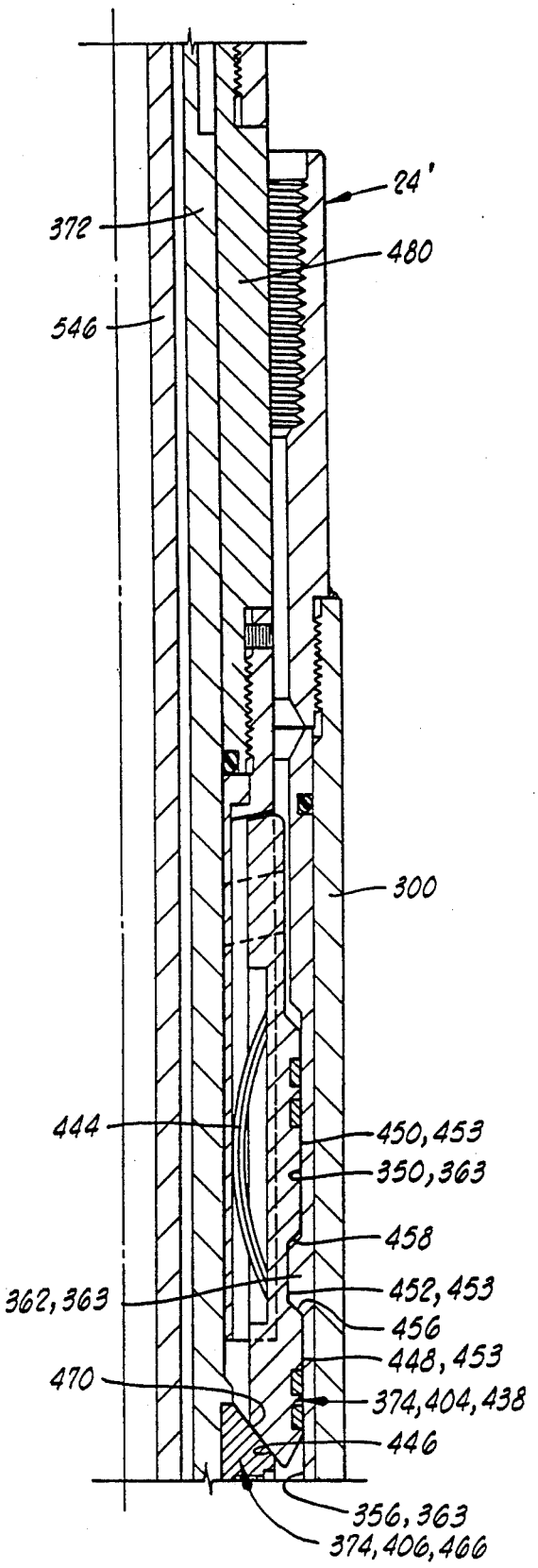
Figure 7E:
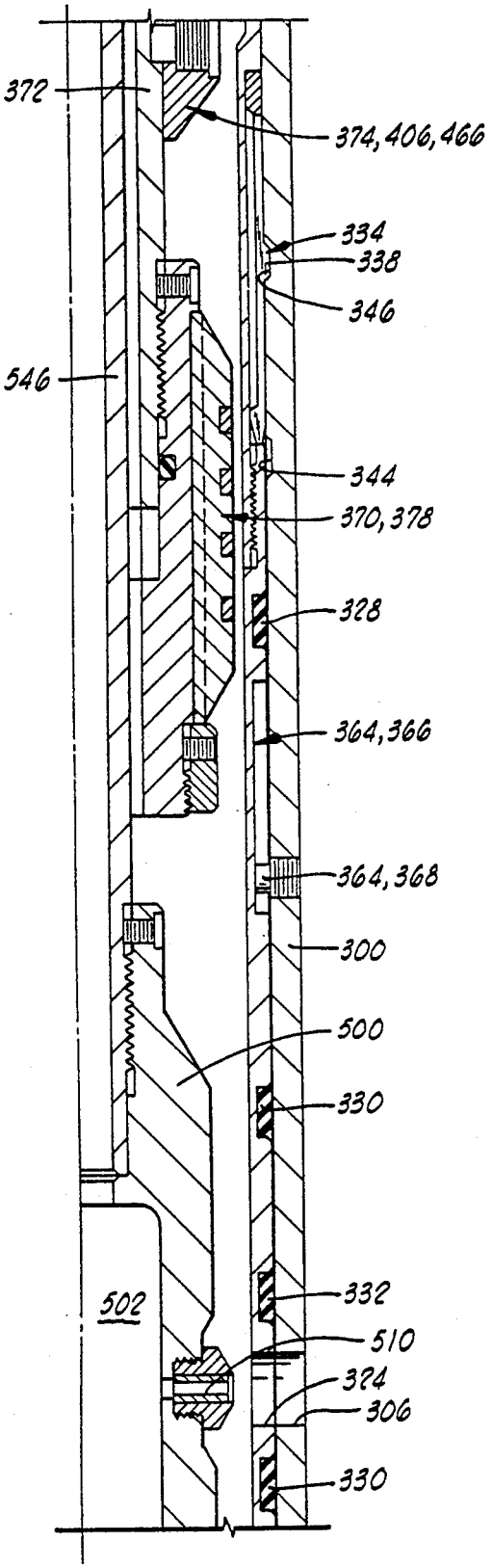
Figure 7F:
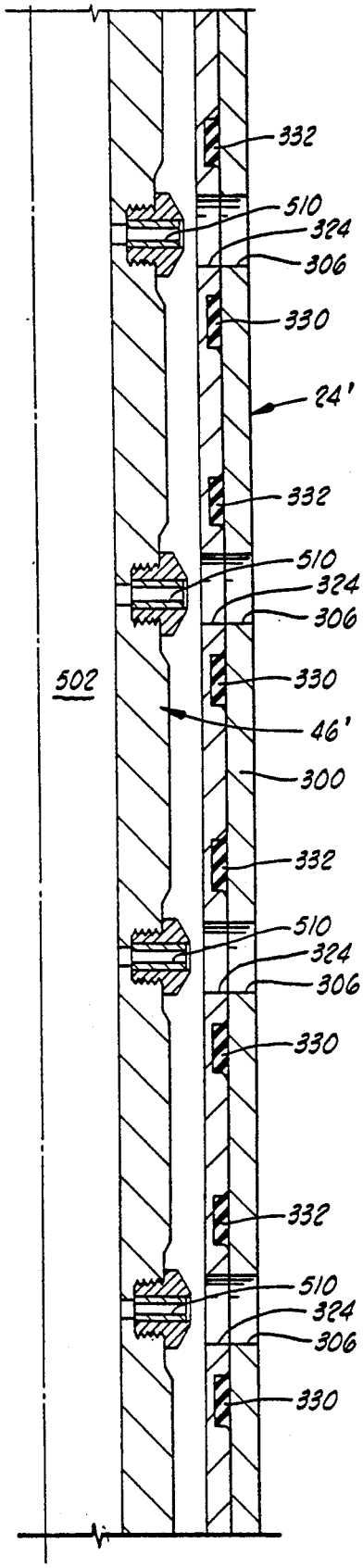
Figure 7G:
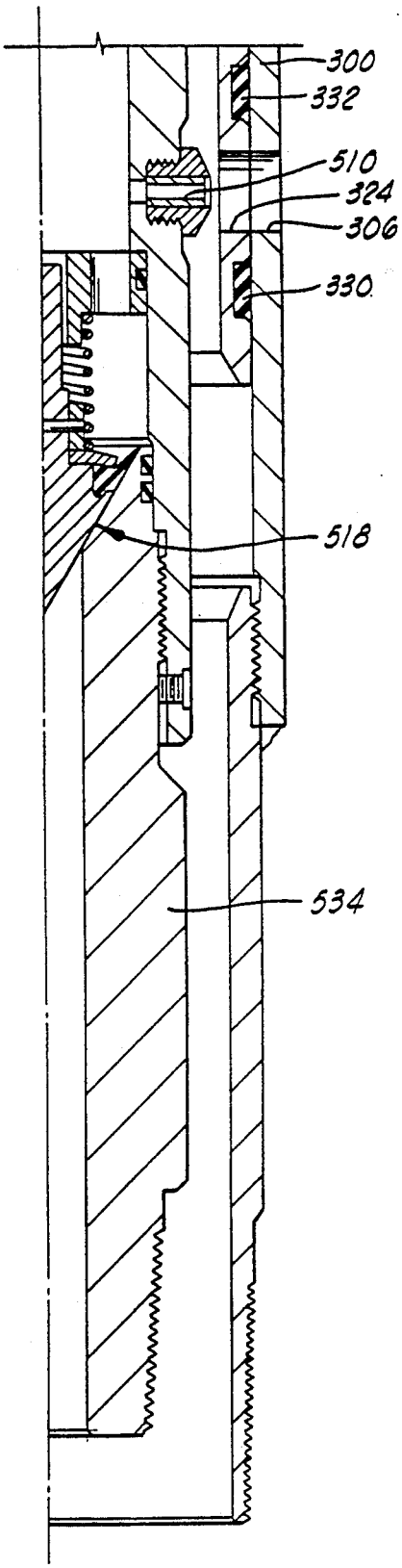

In the embodiment of jetting tool 46 shown in FIGS. 6E-6G, the lower portion further includes a check valve means 518 of a kind known in the art. Check valve means 518 includes a spring seat 520 shouldered against lower end 506 in jetting sub 500 with an O-ring 522 providing sealing engagement therebetween. A biasing means such as a spring 524, is provided for biasing a check valve 526 and an elastomeric seat seal 528 away from spring seat 520. A pilot portion 530 of check valve pilots within spring seat 520 to insure that check valve 526 and seat seal 528 are properly aligned.

Check valve 526 is tapered and engages a corresponding tapered surface 532 within a check valve body 534. Seat seal 528 sealingly engages tapered surface 532 when check valve means 518 is in the closed position illustrated.

Check valve body 534 is attached to jetting sub 500 at threaded connection 536. A set screw 538 locks check valve body 534 to jetting sub 500, and a sealing means, such as a pair of O-rings 540, provides sealing engagement between the jetting sub and check valve body. The lower end of check valve body 534 defines a threaded surface 542 which is adapted for connection to a lower tool string portion if desired.

Check valve means 518 permits tubing string 36' to fill while running into well 10, as well as permitting reverse circulation. It will be seen that check valve means 518 is self-centered to facilitate easy seating thereof when jetting tool 46' is in a horizontal position such as in the deviated portion 22 of well 10.

Jetting tool 46' further includes a rotatable jetting mandrel 546 attached to jetting sub 500 at threaded connection 548, and a sealing means, such as O-ring 550 provides sealing engagement therebetween. A set screw 552 locks jetting mandrel 546 to jetting sub 500. Thus, jetting mandrel 546 is fixedly attached to jetting sub 500 so that jetting mandrel 546 and jetting sub 500 rotate together relative to positioning tool 44'.

Jetting mandrel 546 has a jetting mandrel bore 554 defined therethrough which is communicated with chamber 502 of jetting sub 500.

Jetting mandrel 546 is concentrically and rotatably received through a bore 556 of positioning mandrel 372 of positioning tool 44'.

Jetting mandrel 546 extends upwardly all the way through positioning tool 44' to a swivel 558, best seen in FIGS. 6A and 6B. Swivel 558 can be described as a swivel means 558 for providing a rotatable connection between positioning tool 44' and jetting tool 46', and for connecting positioning tool 44' and jetting tool 46' for common longitudinal movement relative to well 10.

Swivel 558 includes a swivel housing 560 which is connected to inner positioning mandrel 372 at threaded connection 562 with set screws 564 maintaining the connection. An O-ring seal 566 is provided between swivel housing 560 and inner positioning mandrel 372. Swivel housing 560 is made up of a lower housing section 568 and an upper housing section 570 connected at threaded connection 572. An O-ring seal 574 provides sealing engagement between lower housing section 568 and upper housing section 570.

Lower and upper housing sections 568 and 570 define an inner annular recess 576 of swivel housing 560.

Jetting mandrel 546 includes an upper jetting mandrel extension 578 connected to the lower jetting mandrel portion at thread 580. Upper jetting mandrel extension 578 has an outer annular shoulder 582 defined thereon which is received in annular recess 576 of swivel housing 560.

Upper and lower thrust bearings 584 and 586 are disposed in annular recess 576 above and below annular shoulder 582. Upper and lower thrust bearings 584 and 586 are of a kind known in the art and have outer races fixed to swivel housing 560 and inner races fixed to jetting mandrel 546 so that the jetting mandrel is rotatable within the swivel housing.

A sealing means, such as O-ring 588 provides rotating, sealing engagement between swivel housing 560 and upper mandrel extension 578 of jetting mandrel 546.

Another sealing means, such as O-ring 590, provides rotating, sealing engagement between swivel housing 560 and jetting mandrel 546.

An upper end portion 592 of upper mandrel extension 578 extends through the upper end of upper swivel housing 570. Upper guide assembly 376 of guide means 370 is connected at thread 594 to upper end portion 592 of upper mandrel extension 578, with an O-ring seal 596 being provided therebetween.

It will be seen that tubing string 36' is in fluid communication with bore 554 of jetting mandrel 546.

OPERATION OF THE SECOND EMBODIMENT

Operation of the second embodiment is similar to that of the first embodiment. Casing valves 24', 26' and 28' are located in the well in the same manner as casing valves 24, 26 and 28 of the first embodiment. As with the first embodiment, the second embodiment of the present invention is not intended to be limited to wells where the production string is cemented in place, although the discussion which follows describes such a well Casing valves 24' 26' and 28' may also be used in uncemented completion wherein zonal isolation between valves is established by external casing packers or the like. Also, the casing valves may be used in any cemented/uncemented combination.

After cementing, a bit and stabilizer trip is made to clean and remove as much as possible the residual cement lying on the bottom of casing 12' in horizontal section 22 as in the first embodiment.

Tool string 36' of FIGS. 6A–6G is next run into the well. Tool string 36' includes positioning tool 44', jetting tool 46' and wash tool 48, as is schematically illustrated in FIG. 1. In FIG. 1, this tool assembly is shown as being lowered into vertical portion 18 in well 10. The tool assembly will pass through radiused portion 20 and into horizontal portion 22 of well 10. The tool assembly should be run to just below the lowermost casing valve 28'.

Then, hydraulic jetting begins utilizing a filtered clear completion fluid. The hydraulic jetting is performed with jetting tool 46' by pumping fluid down through tubing string 36' and out through jetting orifices 510 to impinge casing bore 17. Jetting tool 46' is moved upwardly through casing valve 28' to remove any residual cement from all of the recesses in the internal portion of casing 28'. This is particularly important when casing 28' is located in a deviated well portion because significant amounts of cement will be present along the lower inside surfaces of casing valve 28'. The cement must be removed to insure proper alignment of positioning tool 44' with sleeve 316. During this jetting operation, positioning tool 44' should be indexed to one of its intermediate positions such as represented by lug positions 474B or 474F so that positioning tool 44' can move upwardly through casing valve 28' without locking engagement with sliding sleeve 316 of casing valve 28'.

As with the first embodiment, the terms "upward" or "downward" are used in context of direction of movement in the well. These terms are used to mean movement along the axis of the well either uphole or downhole, respectively, which in many cases will not be exactly vertical and can in fact be horizontal in a horizontally oriented portion of the well.

After hydraulically jetting the internal portion of casing valve 28', positioning tool 44' is lowered back through casing valve 28' and indexed to the position represented by lug position 474D. Positioning tool 44' is pulled upwardly so that lower wedge 466 engages lower positioner blocks 438 to lock them radially outwardly into the previously described engagement with sliding sleeve 316. Tubing string 36' is pulled upwardly to apply an upward force to sliding sleeve 316 of casing valve 28'.

It will be seen that because of the plurality of port seals 330 and 332 on longitudinally opposite sides of housing communication ports 306, very little upward movement of sliding sleeve 316 is necessary. That is, sliding sleeve 316 must only be moved an amount equal to the initial longitudinal spacing between any housing communication port 306 and the corresponding sleeve communication port 324.

Sliding sleeve 316 is moved upwardly until it abuts upper body 308. At this point collet 338 engages second latch groove 346.

At this time, upward pull on the tubing string is reduced but some force is maintained on opening blocks 410. Tool string 36' is then rotated and the lowest rotary speed possible is maintained. As tubing string 36' rotates, so does jetting tool 46' which is connected to tubing string 36' by jetting mandrel 546. While slowly rotating tool string 36' and jetting tool 46', high pressure fluid is pumped down through tubing string 36' and directed out jetting orifices 510. Each jetting orifice 510 is aligned longitudinally with aligned sets of housing communication ports 306 and sleeve communication ports 324. Thus, fluid jetted out orifices 510 is jetted through the aligned housing communication ports 306 and sleeve communication ports 324.

Once the jetting of the ports and any pressure testing has been completed, positioning tool 44' is indexed to a position represented by lug position 474A wherein positioning mandrel 372 slides downwardly relative to engagement means 404 until upper wedge 464 engages closing blocks 410, thus locking the closing blocks into engagement with sliding sleeve 316. Downward force is then applied to sliding sleeve 316 to cause collet 338 to collapse and move out of engagement with upper groove 346. Sliding sleeve 316 will then slide downwardly until collet 338 engages lower groove 344 and the valve is once again in the position shown in FIGS. 5A–5D.

If desired, blowout preventers 40 can be closed and the casing can be pressure tested to confirm that casing valve 28' is in fact closed.

Then, the tool string is moved upwardly to the next lowest casing valve, such as casing valve 26', and the sequence is repeated. After casing valve 26' has been treated in the manner just described, the tool string is again moved upwardly to the next lower casing valve, such as casing valve 24', until finally all of the casing valves have been hydraulically jetted to remove residual cement and have been reclosed.

Once all of the casing valves have been jetted out and reclosed, the work strings should be pulled up to the top of the liner, or to the top of deviated section 22 of casing 12' and backwashed. Backwashing is accomplished by use of wash tool 48 in a manner known in the art.

Thus, it is seen that the present invention readily achieves the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the appended claims.

What is claimed is:

1. A positioning tool apparatus for positioning a sliding member of a well tool, said apparatus comprising:

an inner mandrel; and operating means for selectively operably engaging the sliding member of the well tool in response to longitudinally reciprocating motion of said inner mandrel, said operating means comprising:

radially outwardly biased engagement means for automatically engaging the sliding member of the well tool when aligned therewith, said engagement means having a pair of engagement surfaces thereon with a recess defined therebetween, each of said engagement surfaces having chamfers at opposite ends thereof and being adapted for engagement with corresponding latching surfaces in the sliding member of the well tool; and locking means, connected to said inner mandrel, for locking said engagement means in operable engagement with the sliding member when said engagement surfaces of said engagement means are engaged with the engagement surfaces of the sliding member.

2. The apparatus of claim 1 wherein said engagement means comprises:

a plurality of positioner blocks circumferentially spaced about a longitudinal axis of said inner mandrel, said engagement surfaces of said engagement means facing radially outwardly on said positioner blocks; and biasing means for biasing said positioner blocks radially outwardly from said longitudinal axis.

3. The apparatus of claim 1 wherein each of said positioner blocks has a tapered locking surface defined on an end thereof.

4. The apparatus of claim 3 wherein said plurality of positioner blocks is a first plurality of positioner blocks; and further comprising:

a second plurality of positioner blocks longitudinally spaced from said first plurality of positioner blocks and circumferentially spaced about said longitudinal axis, each of the second positioner blocks having a pair of radially outwardly facing engagement surfaces thereon with a recess therebetween, each of said engagement surfaces on said second plurality of positioner blocks having chamfers at opposite ends thereof; and a second biasing means for resiliently biasing said second positioner blocks radially outwardly from said longitudinal axis.

5. The apparatus of claim 1 wherein said operating means further comprises position control means, operably associated with said inner mandrel, for permitting said inner mandrel to reciprocate longitudinally and selectively lock and unlock said engagement means with said locking means.

6. The apparatus of claim 5 wherein said engagement means comprises:

a plurality of positioner blocks circumferentially spaced about a longitudinal axis of said inner mandrel, said engagement surfaces of said engagement means facing radially outwardly on said positioner blocks; and biasing means for biasing said positioner blocks radially outwardly from said longitudinal axis.

7. The apparatus of claim 6 wherein each of said positioner blocks has a tapered locking surface defined on an end thereof.

8. The apparatus of claim 6 further comprising a sleeve between said inner mandrel and said biasing means.

9. A position tool apparatus for positioning a sliding member of a well tool, said apparatus comprising:

an inner mandrel;

operating means for selectively operably engaging the sliding member of the well tool in response to longitudinal reciprocating motion of said inner mandrel, said operating means comprising:

radially outwardly biased engagement means for automatically engaging the sliding member of the well tool when aligned therewith, said engagement means comprising:

a plurality of positioner blocks circumferentially spaced about a longitudinal axis of said inner mandrel and having a radially outwardly facing engagement surface thereon, each of said positioner blocks having a tapered surface defined on an end thereof; and biasing means for biasing said positioner blocks radially outwardly from said longitudinal axis;

locking means, connected to said inner mandrel, for locking said engagement means in operable engagement with the sliding member, said locking means comprising an annular wedge having a tapered annular locking surface complementary to said locking surface of said position blocks, said annular wedge being positioned on said inner mandrel so that when said inner mandrel is moved to a first longitudinal position, said annular wedging surface wedges against said tapered locking surfaces and locks said positioner blocks radially outwardly; and position control means, operably associated with said inner mandrel, for permitting said inner mandrel to reciprocate longitudinally and selectively lock and unlock said engagement means with said locking means.

10. The apparatus of claim 9 wherein said plurality of positioner blocks is a first plurality of positioner blocks; and further comprising:

a second plurality of positioner blocks circumferentially spaced about said longitudinal axis, each of the second blocks having a radially outwardly facing engagement surface thereon; and a second biasing means for resiliently biasing said second plurality of engagement blocks radially outwardly from said longitudinal axis.

11. The apparatus of claim 10 wherein said second plurality of engagement blocks defines a tapered locking surface on an end thereof.

12. The apparatus of claim 11 wherein said locking means further comprises a second annular wedge having a tapered annular locking surface complementary to said tapered locking surfaces of said second plurality of engagement blocks; and said tapered annular locking surfaces of said first and second wedges face toward one another with said first and second pluralities of engagement blocks being located between said first and second annular wedges.

13. The apparatus of claim 10 wherein said engagement surface defines at least in part a selective latch profile adapted for matching engagement with a corresponding latching profile in the sliding member of the well tool.

14. The apparatus of claim 13 wherein said engagement surface is one of a pair of spaced engagement surfaces defining a groove therebetween.

15. A downhole tool apparatus comprising:

a casing valve comprising:

an outer housing positionable in a casing string of a well, said outer housing defining a longitudinal passageway therethrough and having a side wall defining a housing communication port therethrough; and a sleeve slidably disposed in said longitudinal passageway and being selectively movable relative to said housing between a first position blocking said housing communication port and a second position wherein said housing communication port is communicated with said longitudinal passageway, said sliding sleeve defining a selective latch profile therein; and a positioning tool comprising:

an inner mandrel longitudinally movable relative to said casing valve; and operating means having a selective latch profile thereon for latchingly engaging said latching profile in said sliding sleeve and thereby moving said sliding sleeve between said first and second positions thereof, said latching profile on said operating means being adapted for preventing engagement with any other portion of the casing string except said latching profile in said sliding sleeve, said latching profile comprising a pair of spaced engagement surfaces thereon, each of said engagement surfaces having chambers at opposite ends thereof, said operating means further comprising:

locking means on said inner mandrel for locking said positioner blocks into engagement with said sliding sleeve and preventing radially inward movement of said positioning blocks when so engaged.

16. The apparatus of claim 15 wherein said operating means further comprises:

a plurality of positioner blocks circumferentially spaced about a longitudinal axis of said inner mandrel, each of said positioner blocks having said engagement surfaces thereon; and biasing means for resiliently biasing said positioner blocks radially outwardly such that said positioner blocks automatically engage the latch profile in said sliding sleeve when the engagement surfaces on said positioner blocks are aligned with the latch profile in said sliding sleeve.

17. The apparatus of claim 16 wherein:

said plurality of positioner blocks has an unlocked position allowing radial inward movement thereof and a locked position preventing radial inward movement thereof; and said operating means further comprises position control means operably associated with said inner mandrel for permitting said inner mandrel to reciprocate longitudinally and selectively lock said positioner blocks in said locked position and unlock said positioner blocks when said positioner blocks are in said unlocked position.

18. The apparatus of claim 17 herein said position control means comprises:

a J-slot defined in one of said inner mandrel and said operating means; and a lug connected to the other of said inner mandrel and said operating means, said lug being received in said J-slot.

19. A downhole tool apparatus comprising:

a casing valve comprising:

an outer housing positionable in a casing string of a well, said outer housing defining a longitudinal passageway therethrough and having a side wall defining a housing communication port therethrough; and a sleeve slidably disposed in said longitudinal passageway and being selectively movable relative to said housing between a first position blocking said housing communication port and a second position wherein said housing communication port is communicated with said longitudinal passageway, said sliding sleeve defining a selective latch profile therein; and a positioning tool comprising:

an inner mandrel longitudinally movable relative to said casing valve; and operating means having a selective latch profile thereon for latchingly engaging said latching profile in said sliding sleeve and thereby moving said sliding sleeve between said first and second positions thereof, said latching profile on said operating means being adapted for preventing engagement with any other portion of the casing string except said latching profile in said sliding sleeve, said operating means comprising:

a plurality of positioner blocks circumferentially spaced about a longitudinal axis of said inner mandrel, each of said positioner blocks having said latch profile thereon;

biasing means for resiliently biasing said positioner blocks radially outwardly such that said positioner blocks automatically engage the latch profile in said sliding sleeve when the latch profile on said positioner blocks is aligned with the latch profile in said sliding sleeve; and locking means on said inner mandrel for locking said positioner blocks into engagement with said sliding sleeve and preventing radially inward movement of said positioning blocks when so engaged, said locking means further including an annular wedge attached to said inner mandrel and having a tapered locking surface thereon complementary to a tapered locking surface on each of said positioner blocks when in a locking position.

20. The apparatus of claim 19 further comprising a plurality of second engagement blocks circumferentially spaced about said longitudinal axis of said inner mandrel and longitudinally spaced from the first mentioned plurality of engagement blocks, each of said second engagement blocks having a tapered locking surface thereon; and wherein said locking means further comprises a second annular wedge having a tapered locking surface thereon complementary to said tapered locking surfaces of said plurality of second engagement blocks.

* * * * *